US005865135A

United States Patent [19]

Price et al.

[11] Patent Number: 5,865,135

[45] Date of Patent: Feb. 2, 1999

[54] METHOD AND APPARATUS FOR PRODUCING A HEMMED FOLDED AND SEAMED FINISHED WORKPIECE

[75] Inventors: Elvin C. Price, Dacula; Preston B. Dasher, Lawrenceville; Tadeusz Olewicz, Hoschton; George Price, Lawrenceville, all of Ga.

[73] Assignee: Atlanta Attachment Company, Lawrenceville, Ga.

[21] Appl. No.: 915,533

[22] Filed: Aug. 15, 1997

[51] Int. Cl.[6] ..... D05B 21/00; D05B 35/04

[52] U.S. Cl. ..... 112/475.06; 112/470.06; 112/470.36; 112/147; 112/DIG. 2; 493/418

[58] Field of Search ..... 112/475.06, 470.05, 112/470.36, 470.06, 470.07, 470.09, 470.16, 141, 147, DIG. 2, DIG. 3; 493/418, 450, 405, 937; 270/32

[56] References Cited

U.S. PATENT DOCUMENTS

| | | | |
|---|---|---|---|
| 2,861,801 | 11/1958 | Cran | 270/68 |
| 3,094,321 | 6/1963 | Kamberg | 270/68 |
| 3,192,885 | 7/1965 | Timm | 112/2 |
| 3,260,518 | 7/1966 | Kamberg et al. | 270/62 |
| 3,554,354 | 1/1971 | Reid | 198/33 |
| 3,776,156 | 12/1973 | Morgan | 112/141 |
| 3,824,964 | 7/1974 | Ryan | 223/30 |
| 3,874,043 | 4/1975 | Holm | 26/68 |
| 3,886,877 | 6/1975 | Akaishi et al. | 112/121.15 |
| 4,061,327 | 12/1977 | Blessing | 270/78 |
| 4,214,541 | 7/1980 | Zeigler, Jr. et al. | 112/262.3 |
| 4,428,315 | 1/1984 | Keeton | 112/262.3 |
| 4,460,350 | 7/1984 | Mittal et al. | 493/412 |
| 4,526,115 | 7/1985 | Kosrow et al. | 112/262.3 |
| 4,528,922 | 7/1985 | Adamski et al. | 112/262.3 |
| 4,530,295 | 7/1985 | Adamski et al. | 112/121.12 |
| 4,531,721 | 7/1985 | Kosrow | 270/45 |
| 4,587,912 | 5/1986 | Yin et al. | 112/262.3 |
| 4,621,585 | 11/1986 | Ball et al. | 112/10 |
| 4,624,198 | 11/1986 | Beam et al. | 112/10 |
| 4,633,604 | 1/1987 | Adamson et al. | 38/2 |
| 4,693,460 | 9/1987 | Adamson et al. | 271/10 |
| 4,754,717 | 7/1988 | Henze et al. | 112/10 |

(List continued on next page.)

OTHER PUBLICATIONS

Profeel Inc., Atlanta, GA, Product Brochure, Adjustable Directional Feeding Air Floatation System.

Profeel Inc., Atlanta, GA, Product Brochure, Automatic seaming system for any standard machine.

*Primary Examiner*—Peter Nerbun

[57] ABSTRACT

A hemming and seaming machine is disclosed, the machine having a hemming conveyor on which a workpiece is moved along a first leg of a U-shaped path of travel toward and through a hemming station which sews a hem in the workpiece. Thereafter, the hemmed workpiece is then moved downstream toward a folding station where a spaced series of first air jets selectively emit a stream of air in a direction opposite the direction of the path of travel between a folding plate and a clamping plate to create a vacuum therebetween to draw the leading edge of the workpiece upward and between the folding plate and the clamping plate. Thereafter, the leading edge of the workpiece is held between the clamping and folding plates while a second series of air jets positioned upstream of the folding plate selectively blows a stream of air underneath the folding plate and against at least a portion the workpiece as it moves along the path of travel. Thereafter, after a pre-determined period of time has elapsed from the detection of the leading edge of the workpiece, or in response to the detection of the trailing edge of the workpiece, the leading edge of the workpiece is selectively released from between the folding and clamping plates. The hems of the folded workpiece are aligned, and the workpiece is then moved to a downstream seamer station along a second leg of the path of travel which sews a seam in the workpiece, whereupon the workpiece is passed on to a workpiece stacking station along a third leg of the path of travel for placement of the finished hemmed, folded, and seamed workpiece into a bundle tray positioned with respect to a machine operator's station.

52 Claims, 11 Drawing Sheets

U.S. PATENT DOCUMENTS

| | | | |
|---|---|---|---|
| 4,784,381 | 11/1988 | Prochut et al. | 271/268 |
| 4,800,830 | 1/1989 | Adamski et al. | 112/303 |
| 4,819,926 | 4/1989 | Kosrow et al. | 270/45 |
| 4,858,546 | 8/1989 | Adamski et al. | 112/286 |
| 4,896,619 | 1/1990 | Adamski et al. | 112/306 |
| 4,911,092 | 3/1990 | Adamski, Jr. et al. | 112/121.1 |
| 4,922,842 | 5/1990 | Adamski et al. | 112/304 |
| 4,928,610 | 5/1990 | Akutsu | 112/153 |
| 4,934,293 | 6/1990 | Yokota et al. | 112/288 |
| 4,967,675 | 11/1990 | Goldbeck et al. | 112/475.06 X |
| 4,972,787 | 11/1990 | Adamski et al. | 112/308 |
| 5,044,289 | 9/1991 | Keeton | 112/178 |
| 5,108,017 | 4/1992 | Adamski, Jr. et al. | 223/37 |
| 5,152,235 | 10/1992 | Goto et al. | 112/63 |
| 5,159,874 | 11/1992 | Adamski, Jr. et al. | 112/262.3 |
| 5,197,722 | 3/1993 | Adamski, Jr. et al. | 270/32 |
| 5,226,378 | 7/1993 | Suzuki et al. | 112/121.1 |
| 5,363,784 | 11/1994 | Adamski, Jr. et al. | 112/121.12 |
| 5,373,797 | 12/1994 | Bottoms et al. | 112/475.06 |
| 5,524,563 | 6/1996 | Huddleston | 112/141 |
| 5,628,264 | 5/1997 | Adamski, Jr. et al. | 112/470.05 |

55
$P_1$
59
61
63
60
64
55
71
68
77
57
56
69
41
65
76
75
73
16
$P_1$

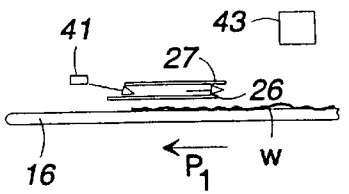
FIG. 10A
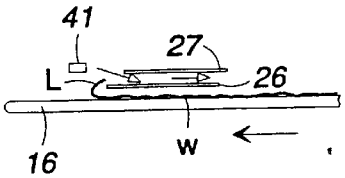
FIG. 10B
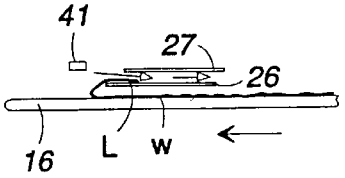
FIG. 10C
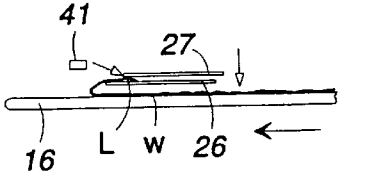
FIG. 10D
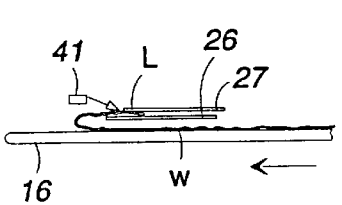
FIG. 10E
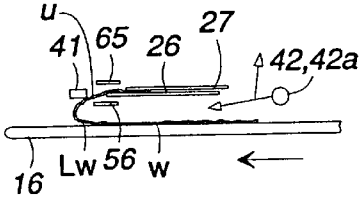
FIG. 10F
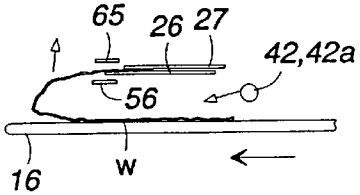
FIG. 10G
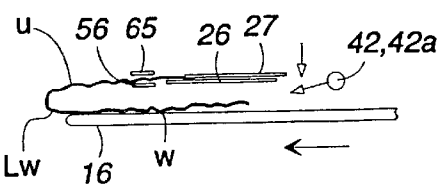
FIG. 10H
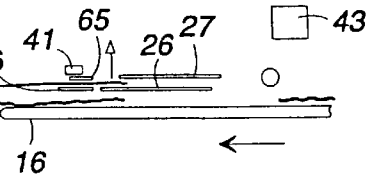
FIG. 10J
FIG. 10I

METHOD AND APPARATUS FOR PRODUCING A HEMMED FOLDED AND SEAMED FINISHED WORKPIECE

FIELD OF THE INVENTION

This invention relates to a method and apparatus for producing a hemmed, folded, and seamed cloth or textile workpiece on an automated hemming and seaming machine. More particularly, a workpiece is passed through a series of work stations on the machine that automatically hem a first edge of the workpiece, fold the workpiece, and align the leading and trailing edges of the workpiece, whereupon the leading and trailing edges of the workpiece are seamed together, and the finished workpieces stacked in preparation for further processing.

BACKGROUND OF THE INVENTION

The production of garments in an industrial setting utilizes the production of batches of garment parts, for example cloth blanks, which are then delivered to separate work stations for being formed into finished workpieces. The finished workpieces are then conveyed to another work station, or work stations, for being combined into the finished item of clothing. For example, it is common for the sleeves of a shirt to be produced at a first work station, typically a hemming and seaming machine, with the body of the shirt being formed at a second work station, and thereafter the body and the sleeves of the shirt are sewn together at a third work station to form the finished garment.

Moreover, the production of these garments is typically accomplished in high volume, high speed operations in which consistent size and quality of the finished workpieces is required in order to arrive at consistently sized and finished items of clothing at the end of the fabrication process. The inherent problem in working with textile workpieces, however, is that they tend to have a natural elasticity which is typically exhibited during handling such that wrinkles or undesired curls or folds may occur in the leading edge, trailing edge, or in the body of the workpiece as it is being processed. If these curls or folds are not removed from the workpiece during fabrication, the finished workpiece may be poorly formed, or formed with defects and inconsistencies in appearance and size so as to require resewing or discarding of these workpieces. In addition, the creation of curls or folds in workpieces requires additional manual or machine operations for removing any such undesired curls or folds from the workpiece, or to correct the workpieces formed with such defects. Thus, there is considerable interest in removing such curls and folds as part of the automated fabrication process to ensure high quality at a high volume.

For example, during the production of shirt sleeves, a workpiece blank having a leading edge, a trailing edge, and a first straight side edge extending between the leading edge and the trailing edge is placed on a hemming machine. Thereafter, a hem is sewn in the first straight side edge of the workpiece as it is moved, leading edge first, along a conveyor and through a hemming station. The hemming station may include a blower or a series of air jets for blowing the curl out of the edges of the workpiece, as well as appropriate workpiece detectors for determining the position of the workpiece in order to automate the process of sewing the hem in the workpiece. Thereafter, to form a finished tubular sleeve, the workpiece must be folded such that the top portion of the hem is aligned with the bottom portion of the hem, and the leading edge is aligned with the trailing edge, if so desired. In the alternative, the workpiece can be folded to a preset size, and any excess leading or trailing edge material will need to be cut off prior to the two edges being sewn together in a seam. However, it is during this folding process that unwanted curls often tend to form in the edges of the sleeve, which can disrupt the seam. Also, it is important for the edges to be properly aligned prior to seaming to avoid waste of material and to ensure consistency of size of the finished sleeves. If the edges are not properly aligned before seaming, the finished sleeves can be formed too small or too large to match the shirt sleeve openings of the shirt bodies. As a result, the sleeve or the material of the shirt bodies about these sleeve openings tends to become bunched or puckered due to the elasticity of the cloth of the sleeve and/or body, which must be stretched to match the sleeve openings for sewing.

A sewing cloth handling device constructed to fold a workpiece, and to remove the curl formed in the leading edge of the workpiece during the folding process, is disclosed in U.S. Pat. Nos. 5,363,784, and 5,197,722, issued to Adamski, Jr., et al. on Nov. 15, 1994, and Mar. 30, 1993, respectively. In the device of the two Adamski, Jr., et al. patents, a workpiece is moved along a path of travel on a conveyor belt toward a sleeve handling (folding) device. Once in the appropriate position, as determined by a sensor, an elongate sleeve pickup blade is moved upwardly from a position beneath the workpiece and engages the underside of the workpiece to drive a leading edge portion upwardly into a pair of spaced jaws formed as a part of a pickup assembly. Thereafter, the leading edge portion of the workpiece, but not the leading edge itself, is held by the jaws as the remainder of the workpiece continues to move along the path of travel on the conveyor to fold the workpiece. To assist in folding the workpiece, a blower is directed in the direction of the path of travel and against the workpiece. Once the workpiece has been folded to the desired size, the jaws release the leading edge portion of the workpiece, but in doing so a fold or a curl is formed at the leading edge of the workpiece. A downstream air blower is thus required in order to direct a jet of air in the direction opposite the direction of the workpiece and into engagement with the folded or curled upper portion of the workpiece to eliminate this fold or curl, all of which is required due to the fold or curl formed in the workpiece by the device of Adamski, Jr., et al. in the first instance. Thus, in order to perform its folding operation, the device of Adamski, Jr., et al. first creates an unwanted problem condition that it must then solve.

What is needed, therefore, is a method and apparatus which automatically hems, folds and seams workpieces but will not introduce any unwanted folds, curls, or wrinkles in the workpieces during the folding thereof. What is also needed, but seemingly unavailable in the art, is a device which not only can fold the workpiece, but can fold the workpiece to a desired size, or can consistently fold a workpiece in half, no matter the size of the workpiece, despite variances between workpieces as they move along a path of travel for hemming and seaming.

SUMMARY OF THE INVENTION

The present invention provides an improved method and apparatus for hemming, folding, and seaming a cloth or textile blank to form finished workpieces, for example a sleeve or a pant leg, of consistently uniform size and quality, and which overcomes some of the design deficiencies of other cloth handling and folding devices known in the art, including minimizing the problem of leading edge folds or curls created during the folding of the workpiece. Thus, the present invention eliminates the formation of such defects in the finished workpieces as the workpieces are being produced, which also allows for greater workpiece production rates. Moreover, the relative simplicity and ease of use of this device, in comparison with known cloth handling and folding devices, allows for a higher degree of flexibility in that this construction is readily adapted for folding workpieces of any type, and of any size, to yield consistently finished high quality workpieces.

The hemmer/seamer of the present invention generally includes a U-shaped machine frame on which a series of work stations are positioned for hemming, folding, seaming and stacking the workpieces. Each workpiece generally has a leading edge, a spaced trailing edge, and a continuous first side edge in which a hem is sewn as the workpiece is moved through a first work station at the start of a hemming/seaming operation. The first work station comprises a hemming station having a first detector, an elongate hemming conveyor extending along a first path of travel, a hemming folder along the conveyor, and a sewing head positioned along the path of travel at the downstream end of the hemming conveyor. As the workpiece is conveyed by the hemming conveyor, its first side edge is uncurled and is trimmed, if need be, whereupon the side edge is then folded under itself by the hemming folder and a hem sewn therein by a sewing head.

A second detector is mounted adjacent the sewing head for detecting the leading and trailing edges of the workpiece as they pass out of the hemming station toward a downstream folding station. The folding station includes a third detector positioned downstream of the sewing head, and a folding plate spaced above and parallel to the work table on which the hemming conveyor is supported, as well as a clamping plate spaced above and parallel to the folding plate. A spaced series of first air jets is positioned downstream of the folding and clamping plates and selectively emit a stream or flow of high velocity air between the folding plate and the clamping plate, respectively, in a direction opposite the path of travel. As a result, a venturi-effect air flow or vacuum is created between the folding and clamping plates which draws the leading edge of the workpiece upwardly between the folding plate and the clamping plate as the remainder of the workpiece continues to pass beneath the folding plate on the hemming conveyor. The clamping plate is constructed and arranged to be reciprocably moved into engagement with the folding plate for clamping the leading edge of the workpiece therebetween.

After the leading edge of the workpiece has been clamped between the clamping and folding plates, both plates may remain stationary with respect to the conveyor, or they may be raised together upwardly and away from the conveyor. A series of spaced second air jets are positioned upstream of the folding plate and selectively emit a stream of low velocity and high volume air flow in the direction of the path of travel beneath the folding plate to at least partially inflate at least a portion of the workpiece while it moves beneath the folding and clamping plates. After a pre-determined period of time has elapsed, or in timed response to the detection of the trailing edge of the workpiece by the third detector, a top ply alignment device extends and engages the top ply of the folded workpiece to align a top portion of the hem of the folded workpiece with a bottom portion of the hem. If the folding and clamping plates have been raised, they are now moved downwardly toward their initial position above the conveyor. Simultaneously, the upstream air jets are turned off and the clamping plate releases the leading edge of the workpiece which is then generally aligned with, and overlaid on the trailing edge of the workpiece as the workpiece passes out of the folding station.

The top ply alignment device is positioned adjacent the folding station, and is constructed and arranged to engage a top portion of the hem of the workpiece and move it into alignment with a bottom portion of the hem received against a stationary guide positioned on the framework of the machine with respect to the hemming conveyor on which the workpiece is being conveyed. Downstream of the folding station and the alignment device is a first transport assembly which includes a movable transport clamp adapted to engage an upper portion of the folded workpiece and to slide the workpiece over a smooth surfaced transport table. The transport table may include a series of pressurized directional airjets mounted flush in the surface thereof for creating an air flotation cushion beneath a lower portion of the folded workpiece such that the workpiece can be easily slid across the surface of the transport table. The first transport clamps engages the workpiece at a first position and moves the workpiece away from the folding station toward a second release position at a first rate of speed and then decelerates the workpiece to a second rate of speed to prevent the collapse of the workpiece or the formation of a curl or a lip in the leading edge of the upper portion of the workpiece caused by the inertia of the workpiece as it is brought to a stop by the first transport clamp. The second, slower rate of speed of the first transport clamp ensures that the leading and trailing edges of the workpiece remain in alignment with one another.

A second transport assembly including a hem clamp is positioned adjacent the release position of the first transport assembly, and includes a transport clamp vertically movable into engagement with the workpiece prior to its release by the first transport clamp, whereupon the first transport clamp releases the workpiece. The second transport clamp is movable in a direction normal to the path of the first transport clamp, and moves the workpiece toward a downstream seamer station, partially rotating the workpiece, if necessary, to align the workpiece with the sewing head of the seamer station so that the appropriate seam may be formed in the workpiece.

A workpiece stacking station is positioned downstream of the seamer station, and includes a transfer plate onto which the finished workpiece is received as it moves out of the seamer station. A side conveyor is positioned adjacent a flip plate positioned at the distal end of the conveyor, and onto which the finished workpiece is placed by the side conveyor, downstream of the transfer plate. The flip plate then places the finished workpiece in a bundle tray positioned adjacent the operator's station of the machine because of the U-shaped configuration of the machine which has the effect or "returning" the now finished workpiece to the operator so the operator may quickly and easily visually inspect the finished workpieces without substantial disruption in the operation of the machine.

It is, therefore, an object of this invention to provide an improved method and apparatus for producing a hemmed, folded, and seamed finished workpiece without the formation of a fold, curl, or a lip in the leading edge of the folded workpiece during the folding process.

It is another object of the present invention to provide an improved method and apparatus for forming a hemmed, folded, and seamed finished workpiece which allows for the machine operator to inspect the finished workpieces once they are completed without leaving the operator's station to ensure that a high production rate of consistently finished workpieces is maintained.

Yet another object of the present invention is to provide an improved method and apparatus for producing hemmed, folded, and seamed finished workpieces which is simple in operation and design, is rugged and durable in structure and in use, and which will ensure the production of a consistently sized, quality finished workpieces.

The present invention accomplishes these objects, among others, while providing for flexible, efficient, and continuous high speed automated hemming, folding, and seaming operations on cloth workpieces.

Other objects, features, and advantages of the present invention will become apparent, therefore, upon reading the following specification, when taken in conjunction with the accompanying drawings.

BRIEF DESCRIPTION OF THE DRAWINGS

FIGS. 10A–J are sequential, schematic, partial side elevational views of a hemmed workpiece being folded using the folding station and alignment device of the hemming and seaming machine of FIG. 1.

DETAILED DESCRIPTION OF THE PREFERRED EMBODIMENTS

Figure 1:
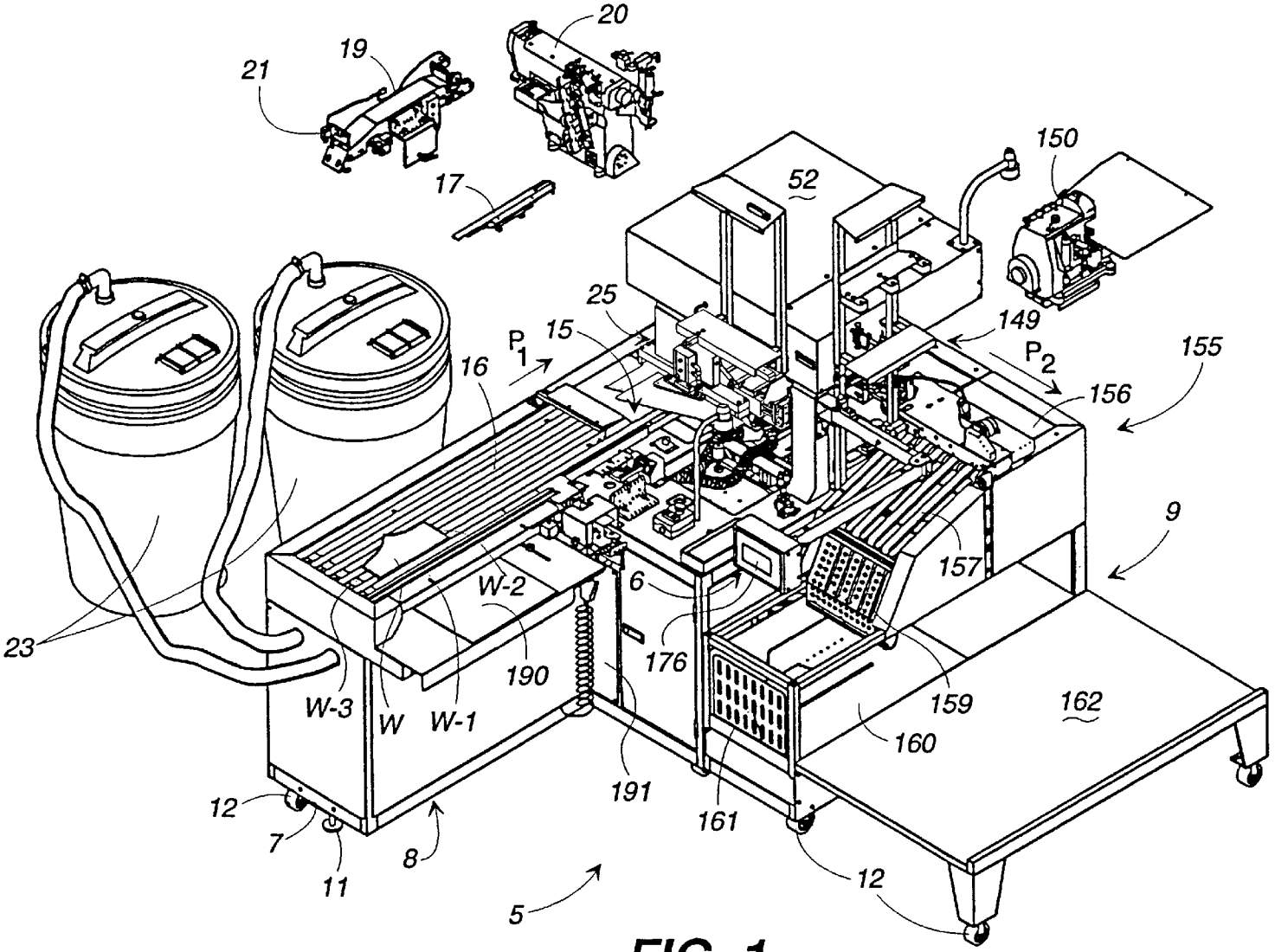
FIG. 1 is a perspective view of a preferred embodiment of the hemming, and seaming machine of this invention.
Figure 2:
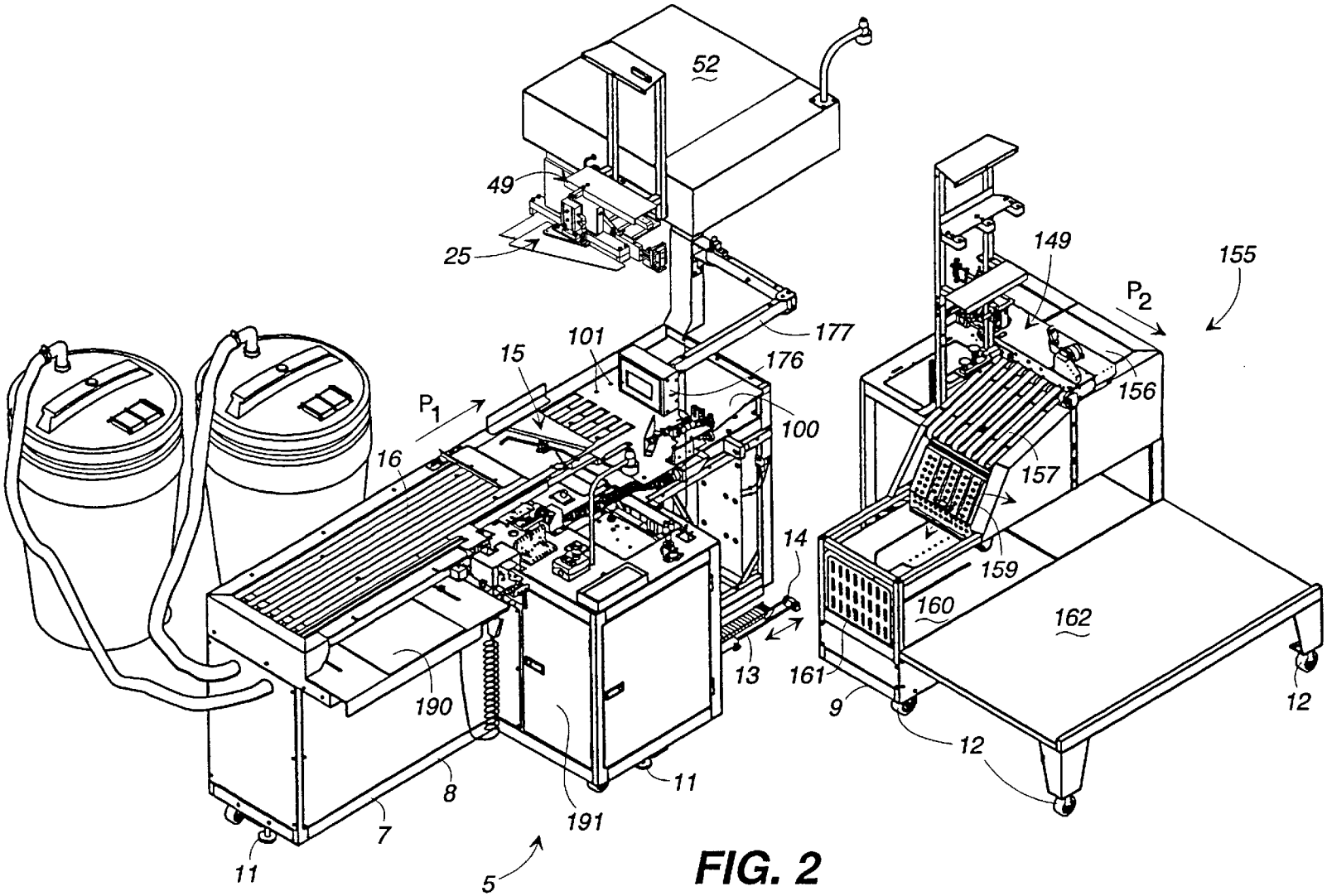
FIG. 2 is a perspective view of the machine of FIG. 1, showing the hemming and seaming machine separated into two subframe components.

Referring now to the drawings, in which like reference numerals indicate like parts throughout the several views, FIGS. 1 and 2 illustrate a preferred embodiment of a hemming and seaming machine 5, hereinafter referred to as the "machine". The machine 5 has a computer control system, generally indicated at 6, and a generally U-shaped cabinet-styled framework 7 comprised of a first subframe assembly 8 and a second subframe assembly 9, as best shown in FIG. 2. The two subframe assemblies of the machine can be moved apart from one another for ease of maintenance, inspection, repair, and/or updating of the machine during its use in clothing manufacturing plants. As shown in FIG. 2, therefore, subframe assembly 9 has a plurality of rollers 12 constructed and arranged to allow for positioning of the machine as well as for moving subframe 9 away from subframe 8. A transport cylinder 13 is mounted to subframe 8 and includes an extensible cylinder rod 14 (FIG. 2) which is operably engaged with subframe 9 for moving subframe 9 toward and away from subframe 8. When the two subframes are drawn together, as shown in FIG. 1, they are locked into position such that the two subframes form a rigid and durable frame U-shaped frame. Transport cylinder 13 will preferably be a pneumatic cylinder, or may include other suitable types of cylinders including, for example, a hydraulic cylinder.

As best shown in FIGS. 1 and 2, machine 5 includes a series of work stations, such as a hemming station 15 positioned at an upstream end of a first path of travel, denoted by the reference character "$P_1$". The hemming station 15 includes a spaced series of endless parallel tape belts/conveyor belts forming a hemming conveyor 16 which extends along and moves in the direction of the path of travel from an upstream toward a downstream end of subframe 8. As shown in FIGS. 1 and 2, however, hemming conveyor 16 does not extend all the way to the downstream end of the subframe, rather it terminates at a smooth surfaced transport table 100, the function of which is described in greater detail later below.

A hemming folder 17 (FIG. 1) is positioned at hemming station 15, extending along and parallel to the hemming conveyor 16. The hemming folder is constructed and arranged to fold a first elongate straight side edge of workpiece W, shown in FIGS. 1 and 2, under itself to form a hem in the workpiece. A series of air jets 18 (FIG. 3) also typically are mounted along the back side of the hemming folder, and direct streams of air laterally across the width of the workpiece for eliminating folds or curls in the workpiece as it is hemmed. A top conveyor 19 (FIG. 1) is provided in conjunction with the hemming folder 17 for moving workpiece W along the first path of travel toward and into engagement with a hemmer sewing head 20 positioned at the downstream end of the hemming folder 17 and conveyor 16.

Hemming station 15 includes a first detector or sensor 21 (FIG. 1) which is mounted at the upstream end of the top conveyor. It is anticipated that the detector will be a photoelectric sensor or similar detection device that detects the presence and absence of the leading and/or trailing edges of each workpiece passed thereby. If the workpiece is not detected for a predetermined period of time, the computer control system 6 shuts the machine 5 down until it is restarted.

Hemmer sewing head 20 can comprise any of the known types of sewing heads manufactured by Yamato, Pegasus, Rimoldi, or other suitable sewing heads known to those of skill in the art. The hemming sewing head 20 receives the folded edge of the workpiece and sews a line of stitches therealong to complete formation of the hem in the workpiece. A second, sewing control sensor 22 (FIG. 3) is mounted upstream of the sewing head 20, and generally is a photoelectric sensor or other detector, for example a proximity detector, directed toward the area of the sewing head. The sewing control sensor detects the leading and trailing edges of the workpiece to control the operation of the sewing head 20. Hemming station 15 (FIG. 1) also is provided with at least one, and in this instance two, waste container assemblies 23 adapted to receive trimmed cloth scraps, or thread chains left over from the sewing of the hem in, and/or from the seaming of, the workpiece.

Downstream of hemming station 15, positioned along hemming conveyor 16, is a second workstation, folding station 25, illustrated generally in FIGS. 1 and 2, and in greater detail in FIGS. 3–5B. Folding station 25 includes a generally planar folding plate 26 spaced above the surface of hemming conveyor 16, along the first path of travel. Spaced above, and parallel to folding plate 26 is a clamping plate 27. A pair of spacer blocks 29 are threadedly fastened to opposed side edges of folding plate 26, and are fastened to the opposite ends of an elongate mounting bar 30. A mounting bracket 31 is fastened to the mounting bar, to which a first two-way cylinder 33, here a dual rod cylinder, having a pair of pneumatic inlets/outlets 34 is fastened. The dual rod cylinder includes a foot 35 which is moved reciprocably toward and away from hemming conveyor 16 when actuated by the appropriate pneumatic controls. The pneumatic controls used to operate the cylinder are not described in greater detail herein as they are well known to those of skill in the art, and are actuated by computer control system 6.

Figure 5B:
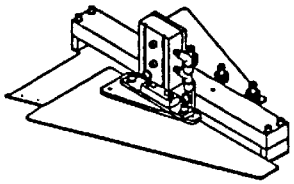
FIG. 5B is a partial perspective view of the folding plate, clamping plate, and two-way cylinder of FIG. 5A in its assembled configuration.
Figure 5A:
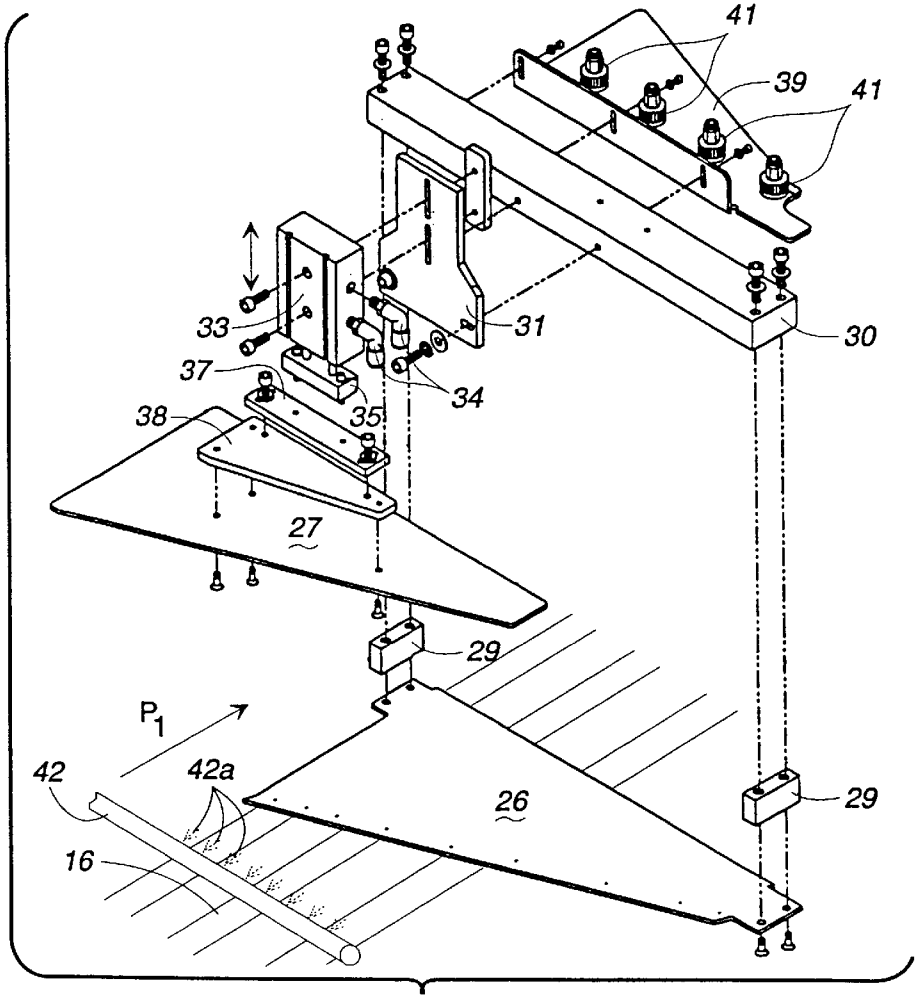
FIG. 5A is a partial, exploded perspective view of the folding plate, clamping plate, and two-way cylinder of the folding station of FIGS. 4A and 4B.

As illustrated in FIG. 5A, foot 35 of cylinder 33 is fastened to a mounting plate 37, and then to an additional mounting plate 38, mounting plate 38 being fastened in turn to clamping plate 27 by suitable fasteners. Although not illustrated specifically in FIG. 5A, it is anticipated that folding plate 26 will be constructed of a stainless steel having a polished exterior surface, and that clamping plate 27 will be constructed of a translucent or clear plastic, preferably of a polycarbonate having a smooth exterior surface. It is anticipated that folding plate 26 and clamping plate 27 could each be constructed of different non-translucent plastic materials, or metallic materials, if so desired, so long as each of the plates is provided with a smooth exterior surface finish to avoid building up a static electrical charge thereon which might possibly form curls in the workpiece.

Figure 9:
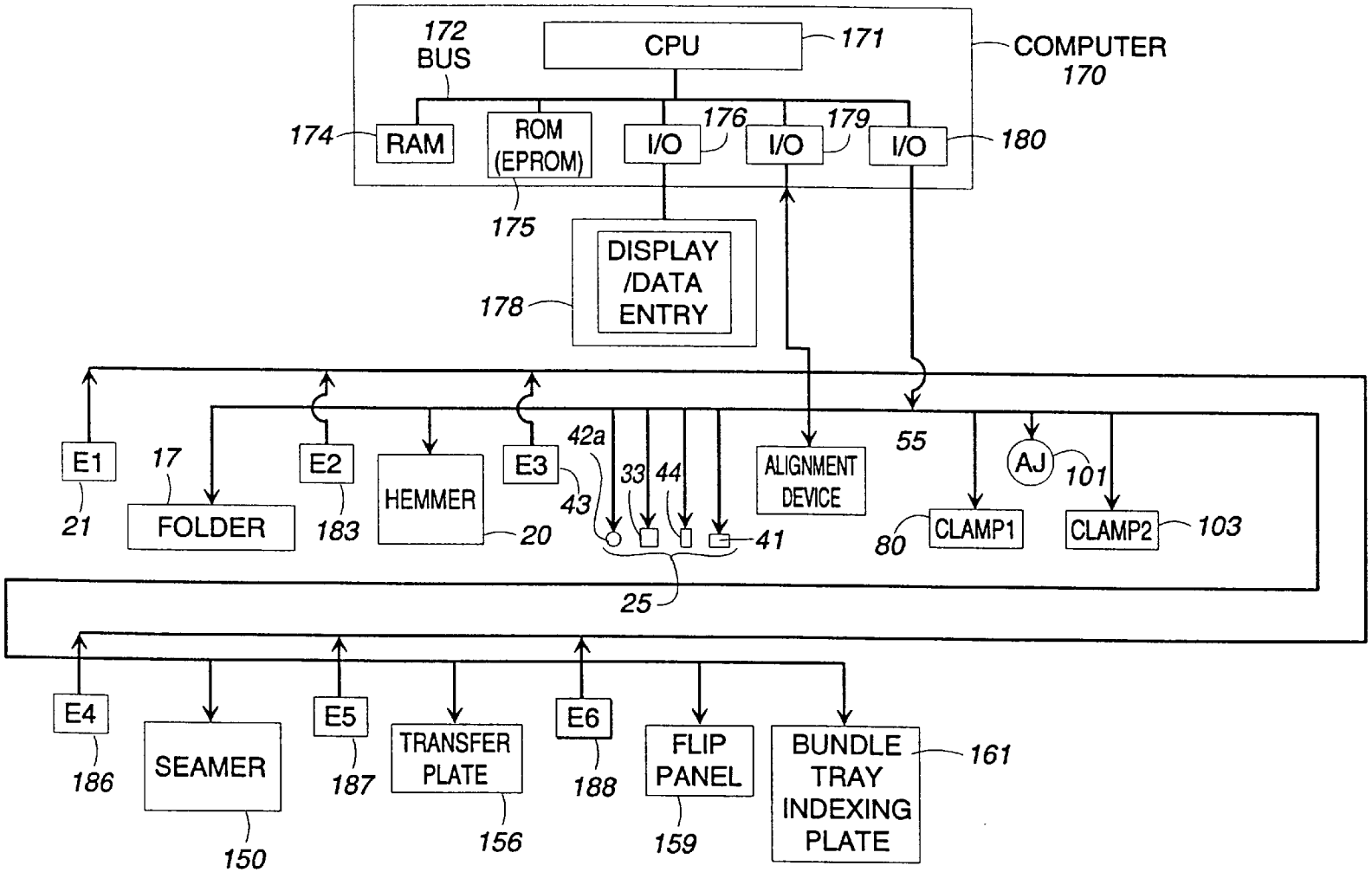
FIG. 9 is a schematic illustration of the control system use to operate the hemming and seaming machine of FIG. 1.

Still referring to FIG. SA, a planar support plate 39 is fastened to the downstream side of mounting bar 30, on which a spaced series, in this instance four, air jets 41 are positioned for selectively directing a stream of air into a plenum formed in the space between clamping plate 27 and folding plate 26. The air jets 41 may include air jets manufactured by Soffie, for example, and are provided with air from an air compressor (not illustrated) provided as a part of machine 5, or as a part of the facility within which machine 5 is used. Each of air jets 41 thus blows a stream of air through the plenum in a direction opposite to the direction of the path of travel, creating a venturi-effect air flow within the plenum which in turn creates a vacuum which draws the leading edge of the workpiece upwardly off of the surface of conveyor 16, and into the space between the folding and clamping plates. Once this occurs, the clamping plate is moved into engagement with folding plate 26 by the actuation of cylinder 33, as illustrated generally in FIGS. 10A–J, and as described in greater detail later below. Each of air jets 41 is actuated by the machine computer control system 6, also described in greater detail later below. It is anticipated, although not illustrated here, that air jets 41 will be supplied with compressed air through suitable air-tight tubing, with the air flow being controlled by any desired pilot valves (not illustrated), and/or solenoid valves (not illustrated), used to govern not only the air flow through the air jets for selectively creating the vacuum between the clamping and folding plates, but for also actuating the pneumatic cylinders and air jets 42*a* of the machine, as controlled by computer 170 (FIG. 9).

Upstream of folding plate 26 and clamping plate 27 is an elongate manifold 42 having a spaced series of second air jets 42*a* defined therein, each of which selectively emits a jet of pressurized air in the direction of the path of travel, and underneath the folding plate 26 during the folding of the workpiece W, as illustrated sequentially in FIGS. 1OA–J, and as further described below. It is anticipated that air jets 42*a* will be air holes defined within manifold 42, although nozzles fastened to, or formed as a part of manifold 42 may also be used. Moreover, specialty air jets designed as such, for example Soffie air jets, could be used as air jets 42*a* if so desired.

Figure 3:
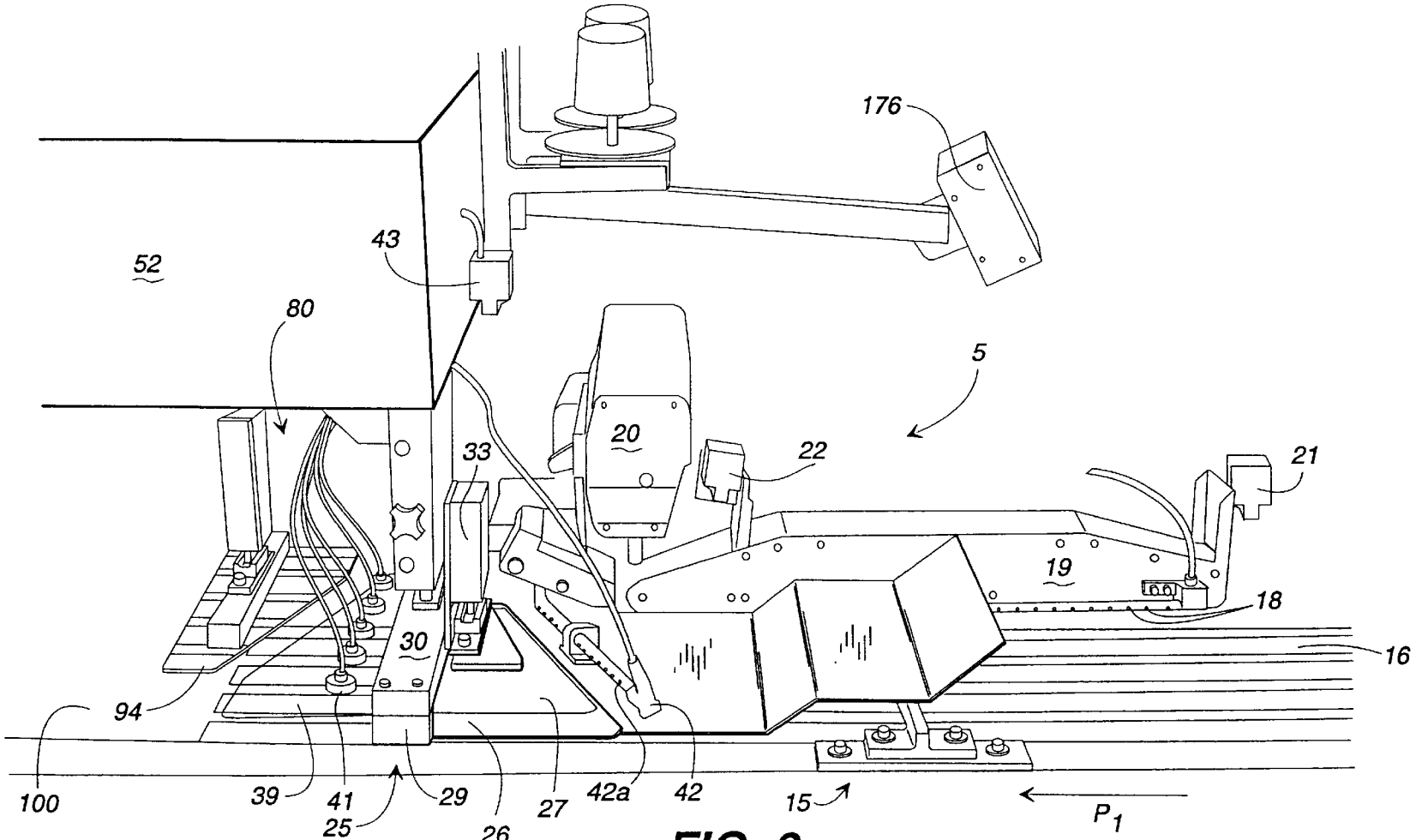
FIG. 3 is a side elevational view of the folding and hemming stations.

As shown in FIG. 3, a third detector 43, a folding sensor, is mounted to the machine frame above the folding and clamping plates immediately downstream of sewing head 20 of the hemming station 15. The folding sensor 43 generally is a photoelectric sensor, but may also be a proximity detector or similar detector, that is adapted to read, i.e., detect, the presence of the leading and trailing edges of the workpiece. In response to detecting the leading edge of the workpiece, the sensor signals the computer control to actuate the first air jets 41 to start the folding operation. In response to detecting the trailing edge, the folding sensor signals the computer control system to deactivate the second air jets 42, and to disengage the clamp and folding plates from one another to complete the folding operation.

Figure 4A:
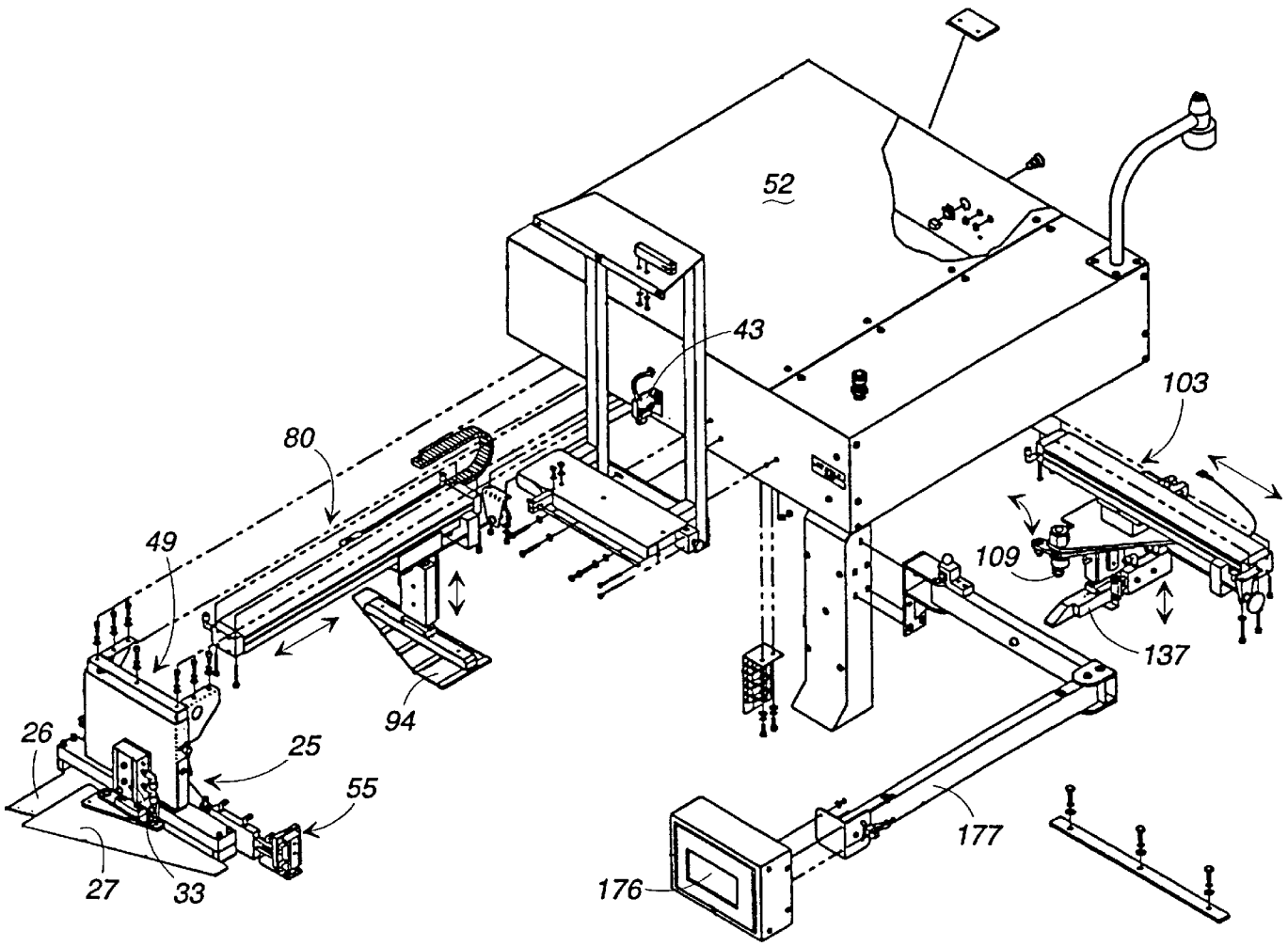
FIG. 4A is a partial exploded perspective view of the folding station, the first transport clamp, and the second transport clamp of the hemming and seaming machine of FIG. 1.
Figure 4B:
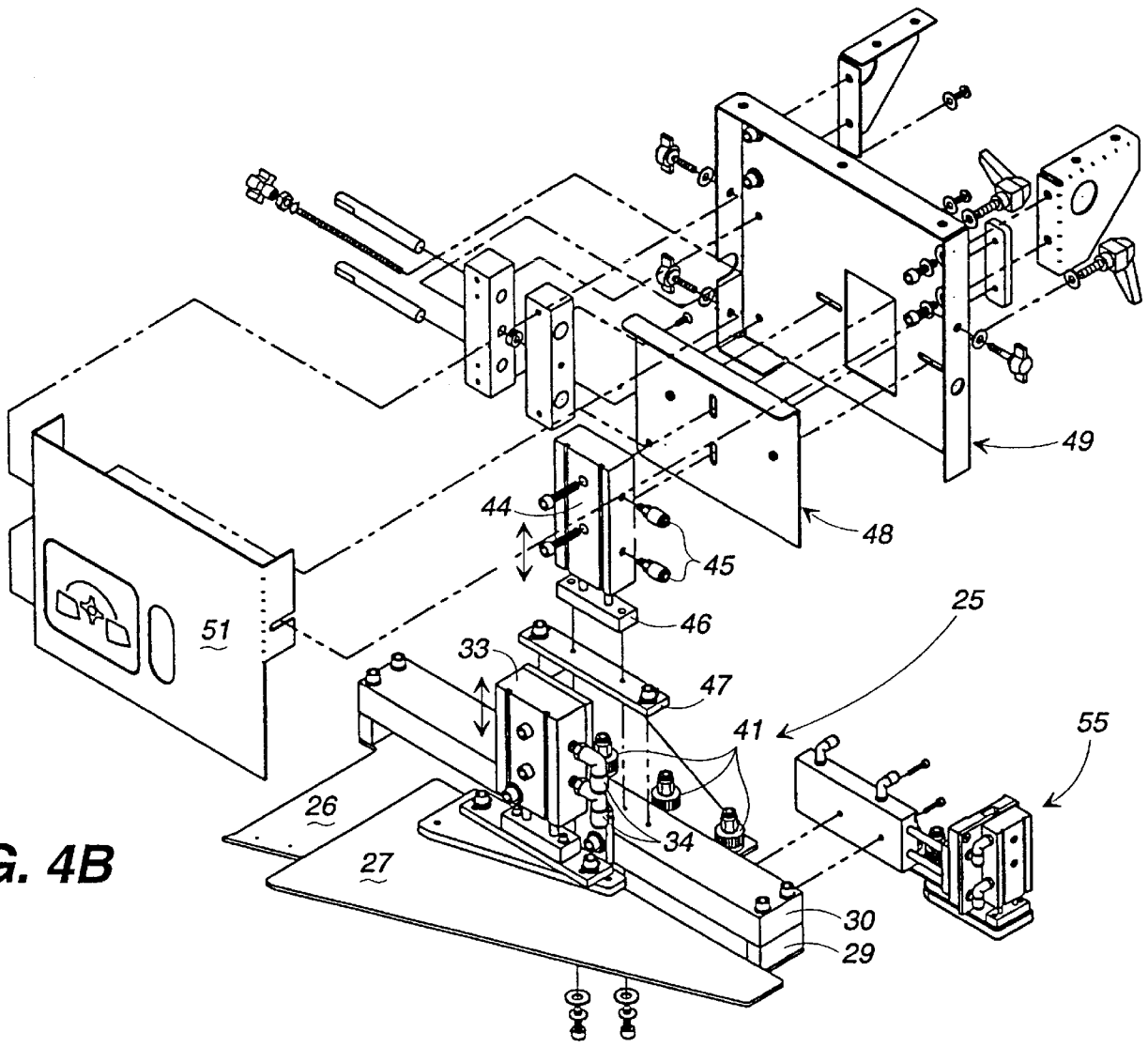
FIG. 4B is an exploded perspective view of the folding station of the hemming and seaming machine of FIG. 1.

Folding station 25, as shown in FIGS. 4A and 4B, includes a second two-way cylinder 44, once again a dual rod cylinder, having a pair of pneumatic inlets/outlets 45, and a foot 46 constructed and arranged to be reciprocably moved toward and away from cylinder 44. Foot 46 is fastened to mounting plate 47, mounting plate 47 in turn being fastened to mounting bar 30. Cylinder 44 is also secured to mounting plate 48, and to a bracket assembly 49, illustrated in FIGS. 3 and 4, the bracket assembly being fastened to overhead frame assembly 52 as shown in FIGS. 1 and 2. A cover plate 51 is received on bracket assembly 49 for enclosing cylinder 44 within a housing formed by the bracket assembly 49 and cover plate 51.

Referring to FIGS. 4A–5B, cylinder 33 is shown fastened to mounting bracket 31, mounting bracket 31 in turn being fastened to mounting bar 30. So constructed, cylinder 33 can independently move clamping plate 27 toward and away from folding plate 26. Cylinder 44, on the other hand, is also fastened to clamping bar 30, however it moves clamping bar 30 to include both folding plate 26 and clamping plate 27, together, toward and away from the surface of hemming conveyor 16, as illustrated schematically in FIGS. 10F–I. Thus, once the leading edge of a workpiece is trapped between folding plate 26 and clamping plate 27 by the actuation of cylinder 33, cylinder 44 may be actuated for lifting both the folding plate and the clamping plate together, upwardly and away from the surface of the conveyor to create a greater space under the folding plate for the air flow created by air jets 42*a* of blower manifold 42, which will at least partially inflate the workpiece as it moves along the path of travel to assist in the folding of the workpiece.

Figures 6A, 6B:
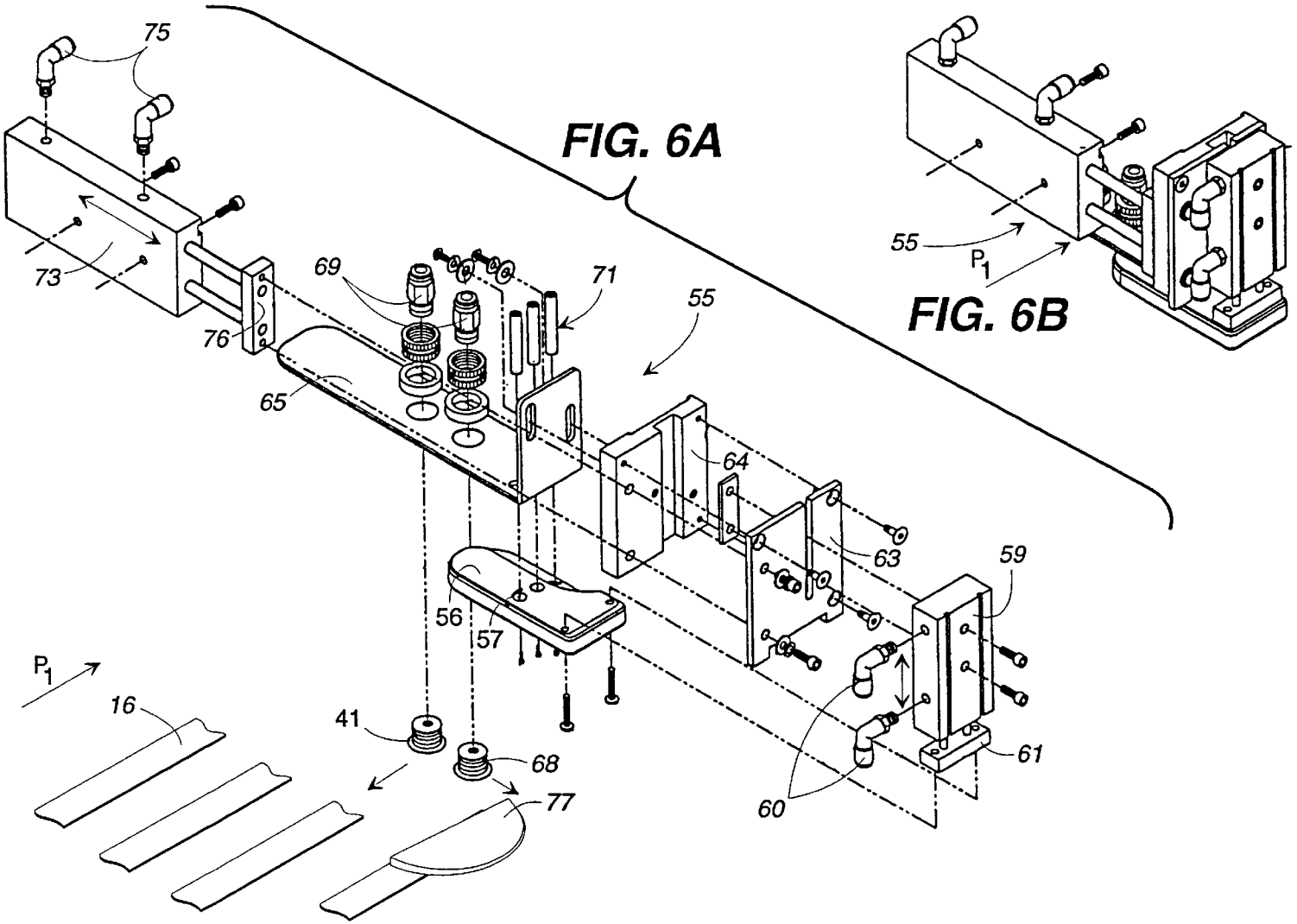
FIG. 6A is a partial exploded perspective view of the alignment device.
FIG. 6B is a perspective view showing the alignment device of FIG. 6A in its assembled configuration.

As shown in FIGS. 4A, 4B and 6A and 6B, a top ply alignment device 55 is positioned at folding station 25, downstream of folding plate 26 and clamping plate 27, and is fastened to mounting bar 30. Referring now to FIG. 6A, the alignment device 55 has a ply separator tongue 56 constructed and arranged to be laterally inserted underneath an upper portion, denoted by the reference character "U" in FIG. 10F, of the workpiece as it is folded, and above a spaced lower portion of the workpiece, denoted by the reference character "Lw". The ply separator tongue serves to separate the two plies of the workpiece so that a top portion of the hem (not illustrated) can be aligned with a bottom portion of the hem (not illustrated) during the folding process, as described in greater detail below.

Ply separator tongue 56 of FIG. 6 includes a spaced series of holes 57 defined therein, for receiving a spaced series of guide, or stop, pins 71 passed downwardly through an upper tongue 65. Ply separator tongue 56 is fastened to a two-way cylinder 59, a dual rod cylinder, having a pair of spaced pneumatic inlets/outlets 60, and a reciprocable foot 61 fastened to the ply separator tongue. Cylinder 59 is fastened to a mounting plate 63, mounting plate 63 being received on a mounting block 64 fastened to upper tongue 65, tongue 65 supporting two air jets, one of which is a first air jet 41 provided as a part of the folding station 25, and one of which is a second air jet 68 provided for aligning the upper portion of the workpiece with the lower portion of the workpiece, and more particularly for directing a stream of air at the upper portion of the workpiece and guiding the top portion of the hem into engagement with the guide pins 71, which form a stop.

Although not shown specifically in FIG. 5, the air jet 41 mounted on upper tongue 65 (FIG. 6A) is received within a cut-out portion of support plate 39, as shown in FIG. 5, and acts in concert with the other ones of air jets 41 to create the venturi-effect air flow in the plenum between clamping plate 27 and folding plate 26. Accordingly, air jet 41 on upper tongue 65 is actuated in concert with air jets 41 on support plate 39, air jet 68 being operated independently of air jets 41 by computer 170 for urging the upper portion of the workpiece toward and into engagement with guide pins 71.

As shown in FIGS. 6A and 6B, the alignment device further includes a two-way cylinder 73, a dual rod cylinder, mounted above the separator tongue and connected to and supporting the mounting plate 63 and upper tongue 65. The cylinder 73 is actuated to move the upper tongue 65 and guide pins 71 into alignment with a stationary guide 77 for setting the position of the alignment device with respect to the workpiece's path of travel. Guide 77 is affixed to the machine and spaced from the hemming conveyor 16, and is positioned slightly downstream of folding plate 26 and clamping plate 27. Thus, once the leading edge of the workpiece is clamped between the clamping and folding plates, and as the hemmed sleeve continues to be moved underneath the folding plate, a bottom portion of the hem will be engaged against the stationary guide.

The position of the stationary guide is manually set by the machine operator at the start of sleeve producing operations. The stroke of cylinder 73 is manually adjusted and set by the machine operator to align the top portion of the hem driven against pins 71 by air jet 68 with the bottom portion of the hem engaged with the stationary guide, thus aligning the top and lower portions of the hem with one another to ensure that the hems of the workpiece are aligned as it is folded on itself at folding station 25. Once the leading edge of the workpiece is released from between clamping plate 27 and folding plate 26, and allowed to move along the path of travel, air jet 68 is actuated such that the upper portion of the workpiece is guided against the pins while dual rod cylinder 73 is actuated to align the guide pins, and thus the top portion of the hem, with stationary guide 77 and the bottom portion of the hem.

Cylinder 73 of the alignment device includes a pair of pneumatic inlets/outlets 75, and a reciprocable foot 76 fastened to mounting block 64 and to upper tongue 65. Cylinder 73 is fastened to mounting bar 30, and thus moves the entire remaining portion of the alignment device toward and away from the clamping bar laterally with respect to the length of the workpiece as the workpiece moves along the path of travel.

Figure 7B:
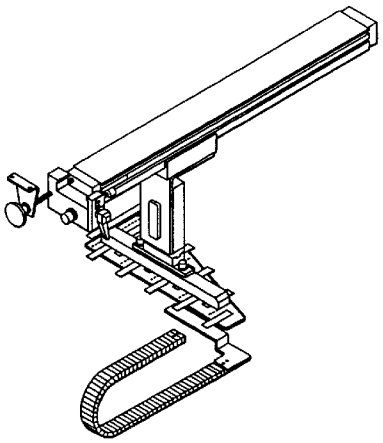
FIG. 7B is a perspective view of the first transport clamp of FIG. 7A in its assembled configuration.
Figure 7A:
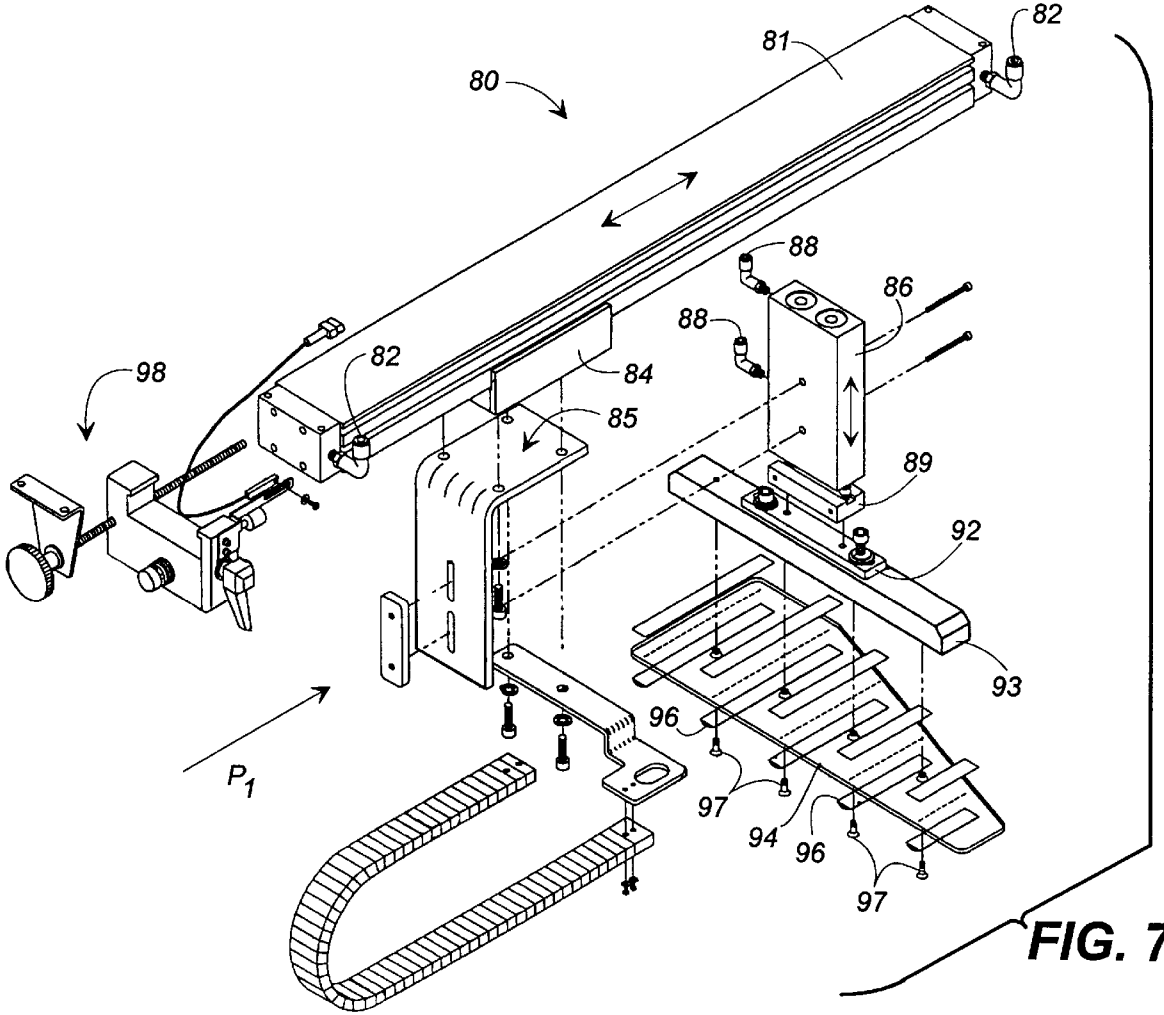
FIG. 7A is an exploded perspective view of the first transport clamp of the hemming and seaming machine of FIG. 1.

As shown in FIG. 3, a first transport clamp assembly 80 is positioned on machine 5 downstream of, and spaced with respect to, folding station 25 and alignment device 55 along what is the first leg of the U-shaped configuration of the machine. The first transport clamp assembly 80 is illustrated in greater detail in FIGS. 7A and 7B. Referring now to FIG. 7A, first transport clamp assembly 80 includes an elongate two-way rodless cylinder 81, having a pair of pneumatic inlets/outlets 82 for reciprocably moving a carrier 84 along the length of cylinder 81. A mounting bracket assembly 85 is fastened to carrier 84, with a two-way, dual rod, cylinder 86 fastened to the mounting bracket assembly 85 for being moved along the path of travel by cylinder 81. Cylinder 86 includes a pair of pneumatic inlets/outlets 88, and a reciprocable foot 89 fastened to a mounting plate 92, the mounting plate 92 being fastened to a clamp bar 93, to which a clamp plate 94 is fastened by fasteners 97.

Two fasteners (not illustrated) are passed through plate 92 (FIG. 7A) and into foot 89 for affixing the clamp bar, and thus clamp plate 94, to cylinder 86. It is anticipated that clamp plate 94 will be constructed of the same material as is clamping plate 27, namely out of a polycarbonate plastic. Clamp plate 94 further typically is provided with a spaced series of elongate rubber grommet strips 96 fastened thereto, generally by glue or other suitable adhesive, on the underside thereof such that the rubber strips of the clamp plate will engage the upper portion of the workpiece when cylinder 86 is actuated to move foot 89 downwardly toward hemming conveyor 16, on which the hemmed and folded workpiece is being transported.

So constructed, the first transport clamp assembly 80 will engage the upper portion of the workpiece when cylinder 86 is actuated to move clamp plate 94, and in particular rubber grommet strips 96, into engagement with an upper portion of the folded workpiece, at a first, engaging position (not illustrated). Cylinder 81 is then actuated by the machine computer control system 170 to accelerate the workpiece away from the folding station and move it along the first path of travel $P_1$ at a first rate of speed greater than the speed at which each workpiece is moved by hemming conveyor 16 toward a second release position. Thereafter, in order to prevent the formation of a curl in the folded leading edge of the workpiece due to momentum from a sudden stop at the first rate of speed, cylinder 81 is decelerated to a second rate of speed less than the first rate of speed so that the workpiece does not collapse, or otherwise allow a curl or a lip to be formed in the leading edge of the workpiece as it comes to a stop at its release position.

As shown in FIG. 7A, cylinder 81 is provided with an adjustable stop assembly 98 for adjusting the stop position of carrier 84 along the length of the first path of travel. This is used to position the clamp plate 94 with respect to folding station 25, alignment device 55, and hemming conveyor 16 as the hemmed and folded workpieces are released from the folding station.

As best shown in FIG. 2, a smooth surfaced transport table 100 formed of stainless steel and having a polished upper surface is positioned downstream of hemming conveyor 16, and it is over this surface which clamp plate 94 will slide the hemmed and folded workpiece until it is stopped after being decelerated. In order to assist the sliding of the workpiece across the transport table, the transport table may include a spaced series of directional pressurized air jets 101 mounted flush therein, each of the air jets being constructed to supply a flow of air to form an air flotation cushion beneath the lower portion of the folded workpice to assist in moving it across the surface of the transport table without inducing any wrinkles, pulls, tears, or curls in the workpiece. It is anticipated that the directional pressurized air jets 101 may include those air flotation system jets known as the "Zyppy Adjustable Directional Feeding Air Flotation Systems" marketed by Profeel, Inc. of Atlanta, Ga., for use in lifting, feeding, and directing materials on the machine table. So constructed, and if provided, air jets 101 assist in directing the workpiece along the first path of travel until the workpiece is stopped by first transport clamp assembly 80 at its release position (not illustrated), whereupon the first transport clamp 94 releases the workpiece after second transport clamp assembly 103 is moved into engagement with the workpiece.

Figure 8:
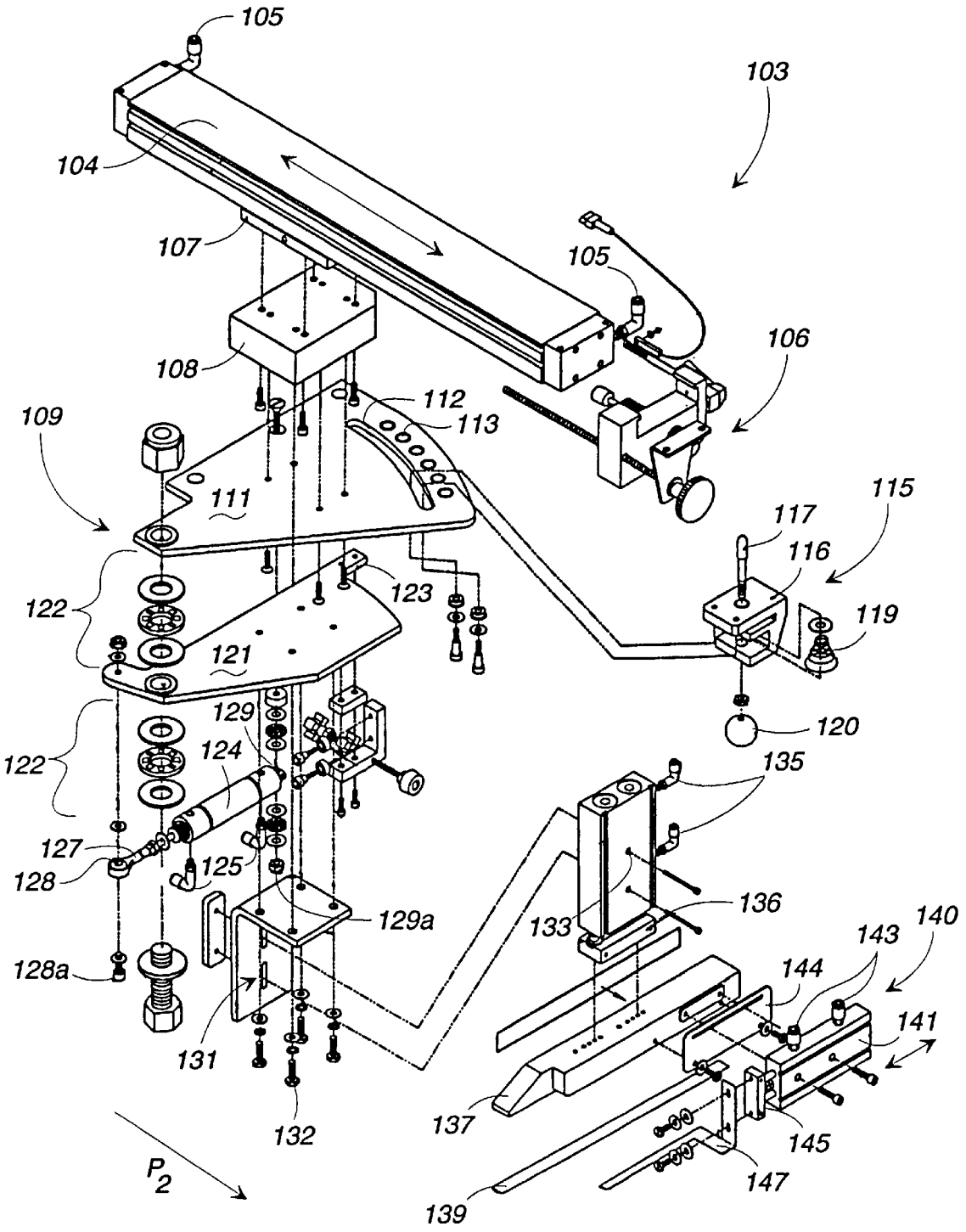
FIG. 8 is an exploded perspective view of the second transport clamp of the hemming and seaming machine of FIG. 1.

Second transport clamp assembly 103 is illustrated in greater detail in FIG. 8. In fashion similar to the first transport clamp assembly, the second transport clamp assembly includes an elongate two-way rodless cylinder 104 having a pair of spaced pneumatic inlets/outlets 105. A carrier 107 is mounted to and moved by the rodless cylinder along a second path of travel, i.e. along the second leg of the U of the U-shaped frame, as denoted by the reference character "$P_2$". A mounting block 108 is fastened to carrier 107 by a plurality of fasteners which are also used to fasten a transport clamp rotate assembly 109 to carrier 107 such that the workpiece can be partially rotated by the transport clamp rotate assembly as the workpiece is being moved toward the seamer station 149 for the purpose of aligning the side edge of the hemmed and folded workpiece to be seamed with the seamer.

As illustrated in FIG. 8, the transport clamp rotate assembly 109 includes an adjustment plate 111 having an arcuate slot 112 defined therein, with a series of radially spaced indexing holes 113 arrayed on the outside edge thereof, and adapted for being used with an adjustable stop assembly 115. Adjustable stop assembly 115 includes a clamp bracket 116 held within arcuate slot 112 by a pair of Allen screws having suitable shoulders thereon for forming a bearing surface of the clamp bracket within arcuate slot 112. The clamp bracket includes an elongate stop pin 117 projecting upwardly therefrom, passed through a tensioning spring 119 held within the clamp bracket, with an adjustment knob 120 used to draw the stop pin downwardly against the tension of spring 119 thus allowing the clamp bracket to be moved and positioned with respect to the appropriate indexing hole 113 on adjustment plate 111. Clamp bracket 116 forms a portion of the stop assembly used to stop pivot plate 121 from movement after the desired rotation of the workpiece.

Still referring to FIG. 8, a pivot plate 121 is positioned immediately below, and spaced from adjustment plate 111 by a series of spacers and bearings 122. Pivot plate 121 has a stop 123 defined thereon which is constructed to engage clamp bracket 116 during the partial rotation of the pivot plate by a two-way pneumatic cylinder 124, having a pair of pneumatic inlets/outlets 125. Cylinder 124 has a cylinder rod 127 with an eye 128 formed at one end thereof, and fastened to pivot plate 121 by a threaded fastener **128*a* and a second spaced eye 129 fastened to adjustment plate 111, and to mounting block 108 by fastener 129*a*. So constructed, when cylinder 124 is actuated by computer 170, pivot plate 121 is moved with respect to adjustment plate 111 until such time as stop 123 engages clamp bracket 116, this having the effect of at least partially rotating the workpiece as it is carried against the surface of the transport table by second transport clamp 103** in fashion described in greater detail below.

A mounting bracket assembly 131 is fastened to pivot plate 121 such that it will travel through the same arcuate path as does the pivot plate when being moved by air cylinder 124. Fasteners 132 are used to fasten mounting bracket assembly 131 to pivot plate 121. A two-way cylinder 133, a dual rod cylinder, is fastened to mounting bracket assembly 131 and has a pair of pneumatic inlets/outlets 135, and a reciprocable foot 136 constructed and arranged to be moved toward and away from cylinder 133. Foot 136 is fastened to an elongate clamp bar 137, having an elongate rubber grommet strip 139 fastened thereto using an adhesive. So constructed, when cylinder 133 is actuated by computer 170 to move foot 136 downwardly toward the surface of transport table 100, rubber grommet strip 139 will engage the upper portion of the folded and hemmed workpiece, and will be positioned to move it across the surface of the table and along the second path of travel by carrier 107. A hem clamp assembly 140 is fastened to clamp bar 137 and has a two-way cylinder 141, a dual rod cylinder, with a pair of spaced pneumatic inlets/outlets 143. Cylinder 141 is fastened to the clamp bar 137 by a mounting plate 144. A reciprocable foot 145 is fastened to cylinder 141, and is engaged with a hem clamp 147 used to clamp the top and bottom portions of the hem in alignment with one another as the seam is sewn in the workpiece.

Before the first transport clamp 94 releases the workpiece, the second transport clamp assembly engages the workpiece, whereupon the first transport clamp releases the workpiece. The second transport clamp then moves the workpiece along a second path of travel "$P_2$" in FIGS. 1 and 2, in a direction normal to the first path of travel $P_1$ toward the downstream seamer station 149 upon the actuation of cylinder 104. Although not illustrated specifically in FIGS. 1 and 2, it is anticipated that a second series of spaced directional air jets could also be provided for assisting in the movement of the workpiece on the surface of the transport table by the second transport clamp assembly 140, in the direction of the second path of travel $P_2$ toward the seamer station 149.

The seamer station 149 is illustrated in FIGS. 1 and 2. The seamer station includes a seamer sewing head 150 of a type known to those of skill in the art, and may include those seamer sewing heads manufactured by Yamato, Pegasus, or Juki. It is also understood by those skilled in the art, although not illustrated specifically herein, that seamer station 149 will be provided with a rotatable guide assembly, and conveyors, used to move the hemmed and folded workpiece through the seamer and into engagement with the needles of the sewing head to form any desired seam in the workpiece during the seaming operation. Seamer station 149 also typically includes a conveyor (not illustrated), typically a top conveyor, used to assist in moving the workpiece from the seamer sewing head toward a downstream workpiece stacking station 155, illustrated in FIGS. 1 and 2, which lies along the third leg of the U-shaped machine frame.

The workpiece stacking station 155, shown in FIGS. 1 and 2, generally includes a hinged transfer or drop plate 156 positioned at the downstream end of the second path of travel $P_2$. As the workpiece is received on the transfer plate, a transfer plate or workpiece stacking station detector 187 (FIG. 9) will signal computer 170, which will in turn drop transfer plate 156 such that the workpiece is transferred to a side conveyor 157, and moved toward a flip panel 159 pivotally fastened to the workpiece stacking station using a two-way air cylinder (not illustrated) to take finished workpieces and place them into a bundle tray 160 positioned with respect to the operator's station 191, shown in FIGS. 1 and 2, at which the machine operator stands, such that the now finished workpiece has in essence been "returned" to the machine operator for visual inspection by the machine operator as the respective workpieces come off of the flip panel and are dropped into the bundle tray. The bundle tray is provided with a movable bundle tray indexing plate 161, generally driven by a pneumatic cylinder (not illustrated) for moving the stacked workpieces along the length of the bundle tray to form a bundle of workpieces, whereupon the bundles of workpieces are then moved by a pusher (not illustrated) onto an adjacent bundle tray 162 for collection and transport to other work stations for use in completing the manufacture of the clothing items with which the sleeves are associated.

The machine 5, as illustrated in FIGS. 1–8, is automatically controlled by a machine control system 6 which includes a computer 170, illustrated schematically in FIG. 9. The computer 170 will preferably be a Z8 microprocessor manufactured by Zilog, which computer is programmed in the Z8 assembly language, although it will be understood that similar microprocessors or computers capable of such control operations can be used in place of the Zilog Z8 microprocessor. Accordingly, CPU (central processing unit) 171 of computer 170 is a Zilog Z8 microprocessor. Computer 170 also includes a data bus 172 in communication with the CPU, a computer readable storage medium, such as RAM 174, which may comprise a magnetic hard disc drive, a magnetic floppy disc drive, a magnetic tape drive, a CD ROM drive, or other data storage means, and a ROM, or read-only memory 175, which in this instance comprises an EPROM onto which the operating program has been programmed, or "burned" as known to those skilled in the art. An outline of the machine operating sequence, as controlled by the program within EPROM 175, is appended hereto as the Appendix.

An input/output card 176 is provided, which is in communication with data bus 172, and with a data display/data entry device 178. It is anticipated that data display/data entry device 178 as illustrated in FIGS. 1 and 2 will typically will be a touch-sensitive data display and data entry screen, or an equivalent user interface. As the computer program is maintained in the EPROM 175, it is anticipated that the machine can be operated in relatively simple fashion merely by using a pre-programmed menu of options displayed on the touch-sensitive display screen 178. The computer 170 also has an input/output card 179 in communication with the data bus 172 and with the detectors used in machine operation for inputting detected or measured conditions such as the presence or absence of a workpiece, or its leading and trailing edges, respectively, to the CPU. Lastly, computer 170 will have an additional input/output card 180 adapted to emit a control signal to the elements of the machine as illustrated schematically in FIG. 9.

Referring now to FIG. 9, the machine 5 generally has seven detectors used to control the automatic operation of the machine. These seven detectors include a first detector, hemmer detector 21 positioned upstream of hemmer sewing head 20; a second detector, the sewing control detector 22 mounted adjacent the sewing head 20; a third detector, folding station detector 43 positioned upstream of folding plate 26 and clamping plate 27; a fourth detector, seamer detector 186 positioned upstream of seamer sewing head 150; a fifth detector, workpiece stacking station (transfer plate) detector 187 positioned upstream of transfer plate 156; a sixth detector, flip panel detector 188 positioned upstream of flip panel 159; and a seventh detector (not illustrated) a full bundle table detector for bundle tray 160. Each of these detectors is preferably a photosensor or a proximity detector constructed and arranged to detect and signal when the leading, and trailing edges, respectively, of a workpiece pass therebeneath. Once detected, the detectors send the appropriate leading or trailing edge detection signal to computer 170 for action by CPU 171 in conjunction with the program stored in EPROM 175, whereupon the appropriate control signals are issued by the CPU 171 through data bus 172, and input/output card 180 to the appropriate elements of the machine as illustrated in FIGS. 1–10.

Although not illustrated in specific detail herein, the motors used to drive the conveyors and sewing heads of the machine are stepper motors, and thus the machine operates on a time delay basis in association with the receipt of the appropriate leading or trailing edge detection signals, as acted upon by the control program held in EPROM 175 and processed within CPU 175 to emit the appropriate control signals to the machine components through input/output card 180. Accordingly, the machine 5 can be operated in automated fashion for allowing for the accurate, concise, and repeatedly consistent manufacture of a quality finished hemmed, folded, and seamed sleeve at a quality level and at production rates heretofore unknown in the art.

OPERATION

The operation of the improved method and apparatus for providing a hemmed, folded, and seamed finished workpiece will now be described in greater detail with reference to FIGS. 1, 2, 6A, and the schematic illustration of FIGS. 10A–J.

Referring first to FIGS. 1 and 2, a workpiece blank, denoted by the reference character "W", is placed on the upstream end of hemming conveyor 16 positioned with respect to hemming folder 17 in a substantially flat, unfolded configuration.

Workpiece W generally is one of a bundle of workpieces (not illustrated), which will be held on a workpiece tray 190 (FIG. 1) positioned at the operator station 192 of machine 5. The straight side edge W-1 of the workpiece to be hemmed is placed against the side of hemming conveyor 16 closest to the operator's station, in line with the hemming station 15. As the operator engages the machine, for example by a foot switch actuated by the machine operator, the workpiece is moved in the direction of the path of travel $P_1$ through the edge trimmer (not illustrated) and the hemming folder, when, and as needed. As it moves through the folder, the side edge W-1 of the workpiece is folded under for forming the hem sewn into the workpiece by hemmer sewing head 20. As shown in FIG. 9, the leading/trailing edges W-2 and W-3 of the workpiece will be detected by hemming folder detector 21 prior to entering hemming folder 17, whereupon a control signal is sent to the computer 170 controlling the operation of the hemming folder and the hemmer sewing head 20. If no workpiece is detected by detector 21, the system is shut down. The leading edge W-2 of the workpiece will then be detected by hemmer detector 22 prior to being passed to the hemmer sewing head, whereupon a control signal is once again sent to computer 170 to start the operation of the sewing head, which sews the hem in the workpiece. Thereafter, the now hemmed workpiece progresses along the path of travel on conveyor 16 toward folding station 25.

As shown in FIGS. 1 and 9, the leading edge of the workpiece is detected by folding station detector 43 as the workpiece advances toward folding plate 26, passing underneath the folding plate as the workpiece moves along the path of travel. Once the leading edge of the workpiece has been detected by folding station detector 43, a signal is sent to computer 170, whereupon based upon the parameters of the control program held in EPROM 175, first air jets 41 are actuated. The air jets direct a flow of air in the direction opposite the path of travel of the workpiece between the folding plate 26 and clamping plate 27 to create the venturi-effect air flow therebetween. This venturi-effect air flow, or vacuum lifts the leading edge of the workpiece upwardly and starts moving the leading edge of the workpiece between the folding and clamping plates. See FIG. 10B.

As the workpiece continues to move along the path of travel on conveyor 16, the leading edge of the workpiece is drawn further between folding plate 26 and clamping plate 27, as shown in FIG. 10C. After a pre-determined period of time has elapsed, computer 170 signals cylinder 33 to move the clamping plate into engagement with the folding plate, thereby pinching or holding the leading edge of the workpiece between the two plates, as illustrated in FIGS. 10D. Thereafter, and if so desired, the computer emits a control signal to two-way cylinder 44 to lift the folding plate and clamping plate together upwardly and away from the conveyor, as second air jets 42*a* are signaled to blow in the direction of the path of travel beneath the folding late for the purpose of at least partially inflating at least a portion of the workpiece to assist in the folding process. This is illustrated schematically in FIG. 10F–G. Although not illustrated in FIG. 10, it is also possible to have the clamping and folding plates remain in their initial clamped position (FIG. E) so that they are not raised upwardly away from the conveyor, in which event the clamping and folding plates, and the workpiece clamped therebetween, are not lifted further above the conveyor and then lowered, as shown generally in FIGS. 10F–H. Air jets 42*a* will still be signaled to blow in the direction of the path of travel beneath the folding plate, regardless of whether the folding and clamping plates are lifted or not.

As the remainder of the workpiece continues to move along the path of travel it passes beneath the folding plate. After a calculated time delay has elapsed from the detection of the leading edge by detector 43, computer 170 signals cylinder 44 so that if the folding and clamping plates have been lifted, the folding and clamping plates begin to move downwardly together toward the conveyor. Also, once a trailing edge detection signal is emitted by detector 43 in response to the detection of the trailing edge of the workpiece, cylinder 33 is signaled by computer 170 to separate the plates to thus release the leading edge of the workpiece so that the workpiece is folded in half on itself regardless of the size of the unfolded workpiece to allow production of fold-in-half workpieces without requiring edge trimming prior to seaming.

As shown in FIG. 10F, at the same time the workpiece is being folded, alignment device 55 is signaled by computer 170 to move laterally into the path of travel such that ply separation tongue 56 passes underneath the upper portion of the workpiece, denoted by the reference character "U", and above the lower portion of the workpiece, denoted by the reference character "Lw", while upper tongue 65 moves above the upper portion of the workpiece. The upper portion of the tongue has an air jet 41 to assist in creating the venturi between the folding and clamping plates, as described above. The alignment device 55 is first moved into position as the leading edge of the workpiece is drawn into the plenum (FIG. 10C) and between the folding and clamping plates so that the air jet 41 on upper tongue 65 can be used to assist in forming the venturi, which creates the vacuum between the folding and clamping plates, illustrated generally in FIGS. 10A through 10D. After the leading edge of the workpiece is released, an alignment air flow jet 68 will direct the upper portion of the workpiece, particularly the top portion of the hem, into engagement with the stop pins 71 (FIG. 6A), as shown in FIG. 10I.

After the leading edge of the workpiece has been released, and the top and bottom portions of the hem have been aligned at alignment device 55, the folded sleeve continues to move downstream along the hemming conveyor until it reaches surface transport table 100, illustrated in FIG. 2. As indicated in FIGS. 10G–I, as the leading edge is pulled from between the clamping and folding plates, it is aligned and matched with the trailing edge to complete the fold, and the drag exerted thereon by the plates tends to prevent wrinkles in or curling of the leading edge. In addition, after the workpiece has been folded, the first air jets 41 may also be momentarily actuated as the leading edge of the now folded workpiece is released from the folding and clamping plates in order to help eliminate any wrinkles in the workpiece during and after alignment of the hems by alignment device 55.

Once at the surface transport table, the workpiece is engaged by clamp plate 94 of first transport clamp assembly 80. The two-way cylinder 86 receives a control signal from computer 170 to move the clamp plate into engagement with the upper portion of the workpiece, whereupon the computer signals two-way cylinder 81 to accelerate the workpiece away from the hemming conveyor, and to then decelerate the workpiece as it moves along the path of travel $P_1$ so that a lip or curl is not formed in the folded leading edge of the workpiece.

After the first transport clamp assembly 80 has moved the workpiece along the path of travel to a release position, but prior to clamp plate 94 releasing the workpiece, a clamp bar 137 of a second transport clamp assembly 103, engages the workpiece after which the transport clamp 94 releases the workpiece. Thereafter, the computer emits a control signal to two-way rodless cylinder 104, which moves the workpiece along a second path of travel $P_2$ extending generally normal to the first path of travel $P_1$, as the workpiece essentially follows a looped path back toward the operator's station 191 (FIG. 1).

As shown in FIG. 8, the second transport clamp assembly 103 is also provided with a transport clamp rotate assembly 109, so that, if desired, the transport clamp rotate assembly can at least partially rotate the hemmed and folded workpiece as it is moved along the surface of transport table 100 toward seamer station 149 (FIG. 1). As shown in FIG. 9, the workpiece is detected by upstream seamer detector 186 as it approaches the seamer station to activate the seamer station. The seamer station engages the workpiece and moves the workpiece toward a seamer sewing head 150 for sewing a seam in the edges of the folded workpiece to finish the workpiece. As the workpiece is passed out of the seamer station along the path of travel $P_2$, it is detected by a downstream workpiece stacking station sensor 187 which notifies the computer of this fact, whereupon the computer 170 signals transfer plate 156 (FIG. 1) to pivotally drop the workpiece onto side conveyor 157.

The side conveyor 157 then moves the workpiece toward a stacking station and underneath a flip plate detector 188 which detects the presence of the workpiece on the flip plate and emits a detection signal to computer 170. In response, the computer emits the appropriate signal to the flip plate 159 so that the workpiece is flipped into bundle tray 160 positioned adjacent the operator station 191. The machine operator may now visually inspect the finished workpiece, and may make adjustments in the machine as necessary, through touch screen 176 or the appropriate manual controls for correcting any discrepancies in the hem, the fold, or the seam. After a sufficient quantity of stacked workpieces are gathered in bundle tray 160, computer 170 emits a signal to bundle tray indexing plate 161, which then pushes the workpieces toward a pusher assembly (not illustrated), which will transversely push the bundled workpieces onto bundle tray 162. Machine 5 thus allows for the automated formation of a high quality finished workpiece accomplished quickly, and with a minimum of operator input such that a consistently sized quality finished workpiece is provided.

In a further embodiment of the present invention, if it is desired that the workpieces be folded to a consistent and pre-determined size, the computer 170 will receive a leading edge detection signal from folding station detector 43 in response to the passage of the workpiece's leading edge beneath the detector. The computer 170 then waits a pre-determined period of time, i.e. a programmed period of time, before signaling cylinder 33 to release the leading edge of the workpiece from between the clamping and folding plates such that the workpiece is folded to a pre-determined size, and not necessarily in half. So folded, this type of workpiece may need to have an extra portion of the leading or trailing edge, respectively, that may be present trimmed at the seamer station 149 by a knife (not illustrated) provided as a part of the seamer station, such a knife being known in the art. Each workpiece so folded, however, will be identically sized during production. Thereafter the computer 170 actuates the first air jets 41 to begin blowing in a direction opposite the path of travel in response to the detection of the leading edge of the workpiece, and the folding operation continues substantially as discussed above.

It is further anticipated although not illustrated specifically herein, that the control program held in EPROM 175 will include a programmed data table, or series of tables, stored in memory such that the operator can select and input desired control parameters from a displayed list of options through data display/entry device 176, a touch-sensitive data display/data entry screen. For example, the operator could specify whether the workpiece is folded to size, or folded in half.

While preferred embodiments of the invention have been disclosed in the foregoing specification, it is understood by those skilled in the art that variations and modifications thereof can be made without departing from the spirit and scope of the invention as set forth in the following claims. In addition, the corresponding structures, materials, acts, and equivalents of all means or step plus function elements in the claims are intended to include any structure, material, or acts for performing the functions in combination with other claimed elements, as specifically claimed herein.

APPENDIX

Machine operating sequence

1 Machine operator turns on power
2 Machine electronics are initialized
3 Machine operator loads workpiece blank on conveyor and steps on start pedal
4 Hemmer conveyor moves sleeve toward hemming folder
5 Hemming folder detector sees leading edge of sleeve
6 Hemmer edge trimmer turns on
7 Hemming folder uncurl air tube starts blowing
8 Hemmer leading edge jet turns on briefly
9 Hemmer detector sees leading edge of workpiece
10 Hemmer sewing head starts
11 Chain vacuum turns on
12 Puller turns at chaining speed
13 Leading edge of workpiece reaches hemmer needles
14 Foot drops, tensioners on (close), conveyor turns at sync. speed
15 Puller turns at sewing speed
16 Just before leading edge of workpiece reaches knife: knife cuts chain; chain vacuum turns off
17 Folding station detector sees leading edge of workpiece, workpiece moves under folding plate on hemmer conveyor
18 Leading edge air jets turn on
19 Programmed timed delay
20 Clamping plate drops and engages folding plate to hold leading edge of workpiece
21 Programmed timed delay
22 Folding and clamping plates moved upwardly together away from hemmer conveyor
23 Leading edge air jets turn off
24 Programmed timed delay
25 Alignment device moved downwardly
26 Fold-in-half (upstream) blower turns on
27 Programmed timed delay
28 Alignment device moved laterally between top portion and spaced bottom portion of workpiece
29 Programmed timed delay
30 Alignment device raises
31 Hemming detector sees trailing edge of workpiece, trailing edge reaches hemming needles
32 Foot raises, tensioners off (open)
33 Puller turns at chaining speed
34 Programmed timed delay
35 Knife cuts chain
36 Chain vacuum turns on
37 Hemmer sewing head and chain vacuum turn off
38 Folding station detector sees trailing edge of workpiece
39 Fold-in-half blower turns off
40 Folding and clamping plates move together downwardly toward hemming conveyor
41 First transport clamp engages workpiece
42 Clamping plate moved away from folding plate to release leading edge of workpiece
43 Programmed timed delay
44 Leading edge air jets turn on
45 Alignment device alignment air jet turns on
46 First transport clamp is accelerated away from folding station
47 Workpiece is pulled clear of alignment device
48 Alignment device retracts (moves laterally away from the path of travel)
49 Leading edge air jets turn off
50 First transport clamp begins to decelerate
51 First transport clamp reaches end of travel
52 Hem clamp on second transport clamp extends
53 Second transport clamp engages workpiece
54 First transport clamp releases workpiece
55 First transport clamp returns home and deceleration is turned off
56 Second transport clamp moves along path of travel extending away from first path of travel, workpiece rotated to adjustable stop for alignment with seamer 57 Second transport clamp reaches end of travel
58 Seamer detector sees leading edge (hem) of workpiece
59 Hem clamp retracts
60 Seamer foot drops
61 Back latch vacuum turns on
62 Second transport clamp releases workpiece
63 Second transport clamp returns to home position
64 Side conveyor (seamer) moved toward workpiece
65 Seamer guide wheels engage workpiece from idle position
66 Programmed timed delay
67 Seamer guide wheels rotate to straight position
68 Side conveyor jog turns off (if on)
69 Seamer sewing head turns on, side conveyor on
70 Programmed timed delay
71 Back latch vacuum turns off
72 Seamer detector sees trailing edge of workpiece
73 Seamer guide wheels raise up
74 Seamer guide wheels rotate back to idle position
75 Trailing edge of workpiece reaches seamer needles
76 Untensioners open for minimal tension
77 Seamer waist venturi turns on
78 Programmed timed delay
79 Seamer sewing head turns off
80 Side conveyor jog turns on
81 Stacker conveyor turns on
82 Programmed timed delay
83 Back latch vacuum turns on
84 Seamer knife cuts stretched chain
85 Back latch vacuum turns off
86 Untensioners close for full thread tension
87 Side conveyor raises
88 Seamer waist venturi turns off
89 Workpiece stacking station detector sees leading edge (hem) of workpiece
90 Stacker transfer plate wheels drop, and plate drops
91 Workpiece stacking station detector sees folded edge of workpiece (trailing edge)
92 Stacker transfer wheels raise, and transfer plate raises flush with seamer
93 Flip door detector sees trailing (fold) edge of workpiece
94 Programmed timed delay
95 Flip door moved to place workpiece in bundle tray
96 Workpiece and bundle counts started/incremented

We claim:

1. A method of folding a workpiece having a leading edge, a spaced trailing edge, and a continuous hem sewn at a hemming station along an elongate side edge of the workpiece extending between the leading edge and the trailing edge thereof, the hemmed workpiece being conveyed leading edge first along a first path of travel on a conveyor, said method comprising the steps of:

a) detecting the leading edge of the work piece as it is moved along the first path of travel toward a folding station;

b) creating a vacuum between a folding plate and a clamping plate spaced from the folding plate at the folding station;

c) drawing the leading edge of the workpiece away from the conveyor and between the folding plate and the clamping plate in response to the detection of the leading edge of the workpiece with said vacuum;

d) clamping the leading edge of the workpiece between the folding plate and the clamping plate as the remainder of the workpiece continues to move beneath the folding plate and along the path of travel; and e) folding the workpiece over onto itself in response thereto.

2. The method of claim 1, wherein the step of creating a vacuum between the folding plate and the clamping plate comprises the step of actuating a series of first air jets in response to detecting the leading edge of the workpiece.

3. The method of claim 2, wherein the step of creating a vacuum between the folding plate and the clamping plate further includes creating a venturi-effect airflow between the plates with the first air jets and directing said venturi-effect airflow in a direction opposite the direction of the first path of travel.

4. The method of claim 1, step d) further comprising the steps of:

i) moving the clamped folding plate and clamping plate together away from the conveyor and carrying the leading edge of the workpiece away from the conveyor in response thereto;

ii) directing an air flow beneath the folding plate and in the direction of the path of travel against the workpiece and at least partially inflating at least a portion of the workpiece between the folding plate and the conveyor to assist in folding the workpiece; and iii) stopping the air flow, moving the folding plate and the clamping plate together toward the conveyor, and releasing the leading edge of the workpiece from between the folding plate and the clamping plate in response thereto.

5. The method of claim 1, step d) further comprising the steps of:

i) directing an air flow beneath the folding plate and in the direction of the path of travel against the workpiece and at least partially inflating at least a portion of the workpiece between the folding plate and the conveyor to assist in folding the workpiece; and ii) stopping the air flow, moving the folding plate and the clamping plate together toward the conveyor, and releasing the leading edge of the workpiece from between the folding plate and the clamping plate in response thereto.

6. The method of claim 1, further comprising the step of aligning a top portion of the hem with a bottom portion of the hem as the workpiece is being folded over onto itself.

7. The method of claim 6, the step of aligning the top portion of the hem with the bottom portion of the hem comprising the steps of:

i) moving the bottom portion of the hem into engagement with a stationary guide positioned downstream of the folding station with respect to the conveyor carrying the workpiece as the leading edge of the workpiece is clamped between the folding plate and the clamping plate;

ii) moving the top portion of the hem toward and into engagement with a stop spaced from and movable into alignment with said guide; and iii) aligning said stop with said guide so that the top portion of the hem is aligned with the bottom portion of the hem in response thereto.

8. The method of claim 6, the step of aligning the top portion of the hem with the bottom portion of the hem comprising the steps of:

i) inserting a ply separation tongue between an upper portion of the folded workpiece and a lower portion thereof and moving the bottom portion of the hem of the workpiece into engagement with a stationary guide positioned downstream of the folding station with respect to the conveyor carrying the workpiece while the leading edge of the workpiece is clamped between the folding plate and the clamping plate;

ii) releasing the leading edge of the workpiece from between the folding plate and the clamping plate;

iii) directing an alignment air flow against the upper portion of the workpiece and moving the top portion of the hem over the ply separation tongue toward and into engagement with a stop spaced from and movable into alignment with said guide; and iv) moving said stop into alignment with said guide and aligning the top portion of the hem with the bottom portion of the hem in response thereto.

9. The method of claim 1, further comprising the step of releasing the leading edge of the workpiece from between the folding plate and the clamping plate as the workpiece continues along the path of travel.

10. The method of claim 9, further comprising the steps of:

i) moving a first transport clamp into engagement with the folded workpiece;

ii) accelerating the workpiece away from the folding plate at a first rate of speed with said first transport clamp along the path of travel; and iii) then decelerating said first transport clamp and the workpiece to a second rate of speed less than said first rate of speed for preventing the collapse of the workpiece and the formation of a curl in the leading edge of the workpiece.

11. The method of claim 9, further comprising the steps of:

i) moving a first transport clamp into engagement with an upper portion of the folded workpiece; and ii) holding a lower portion of the folded workpiece against a smooth surfaced transport table.

12. The method of claim 9, wherein the step of releasing the leading edge of the workpiece from between the folding plate and the clamping plate comprises the steps of:

i) detecting the trailing edge of the workpiece;

ii) delaying the release of the leading edge of the workpiece from between the folding plate and the clamping plate for a period of time calculated in response to the detection of the trailing edge of the workpiece; and iii) folding the workpiece in half over onto itself in response thereto.

13. The method of claim 9, wherein the step of releasing the leading edge of the workpiece from between the folding plate and the clamping plate comprises the steps of:

i) releasing the leading edge of the workpiece from between the folding plate and the clamping plate after a pre-determined period of time has elapsed from the detection of the leading edge of the workpiece; and ii) folding the workpiece over onto itself to form a workpiece of a predetermined folded size in response thereto.

14. A method of producing finished workpieces, for example sleeves and pant legs, on a hemming and seaming machine, the machine having an operator's station from which the machine is operated, each workpiece having a leading edge and a spaced trailing edge, said method comprising the steps of:

a) placing the workpiece on a conveyor moving along a first path of travel toward a hemming station;

b) forming a hem in the workpiece along a first side edge of the workpiece extending between the leading edge and the trailing edge thereof;

c) conveying the hemmed workpiece, leading edge first, along said conveyor toward a downstream folding station;

d) detecting a leading edge of the workpiece as it is moved along said conveyor toward said folding station;

e) forming a vacuum between a folding plate and a clamping plate spaced from the folding plate in response to the detection of the leading edge of the workpiece;

f) drawing the leading edge of the workpiece upwardly and away from the conveyor and holding the workpiece between the folding plate and said clamping plate with said vacuum;

g) folding the workpiece over onto itself as the remainder of the workpiece continues to move beneath the folding plate and along the first path of travel;

h) transferring the workpiece to a downstream seamer station;

i) sewing a seam in a second side edge of the workpiece;

j) moving the workpiece toward a downstream workpiece stacking station and onto a flip panel positioned at said workpiece stacking station; and k) transferring the workpiece from the flip panel into a bundle tray positioned with respect to the machine operator's station for permitting visual inspection of the completed workpieces by the machine operator.

15. The method of claim 14 and further including the step of aligning a top portion of the hem with a bottom portion of the hem while folding and releasing the workpiece.

16. The method of claim 15, wherein the step of releasing the leading edge of the workpiece from between the folding plate and the clamping plate further comprises the steps of detecting the trailing edge of the workpiece as the workpiece moves along said first path of travel, delaying the release of the leading edge of the workpiece from between the folding plate and the clamping plate for a period of time calculated in response to the detection of the trailing edge of the workpiece, and folding the workpiece in half over onto itself in response thereto.

17. The method of claim 15, wherein the step of releasing the leading edge of the workpiece from between the folding plate and the clamping plate further comprises the steps of delaying the release of the leading edge of the workpiece from between the folding plate and the clamping plate for a pre-determined period of time after the detection of the leading edge of the workpiece, and folding the workpiece over onto itself to form a workpiece of a pre-determined folded size in response thereto.

18. The method of claim 14, wherein the step of forming said vacuum between the folding plate and the clamping plate includes the step of creating a venturi-effect airflow between the folding plate and the clamping plate, and directing said venturi-effect airflow in a direction opposite the direction of the first path of travel.

19. The method of claim 14 and further comprising the steps of moving the folding plate and clamping plate away from the conveyor together and lifting the leading edge of the workpiece away from the conveyor in response thereto, directing an air flow beneath the folding plate and in the direction of the path of travel against the workpiece and at least partially inflating at least a portion of the workpiece between the folding plate and the conveyor in response thereto, stopping said air flow, and moving the folding plate and the clamping plate together downwardly toward the conveyor and releasing the workpiece from between the folding plate and the clamping plate.

20. The method of claim 14 and further including the steps of moving the bottom portion of the hem into engagement with a stationary guide positioned downstream of the folding station with respect to the conveyor as the leading edge of the workpiece is clamped between the folding plate and the clamping plate, releasing the leading edge of the workpiece, moving the top portion of the hem toward and into engagement with a stop spaced from and movable into alignment with said guide, and aligning the stop with said guide to align the top portion of the hem with the bottom portion of the hem in response thereto.

21. The method of claim 14 and further including the steps of:

i) moving the bottom portion of the hem against a stationary guide positioned downstream of the folding station with respect to the conveyor;

ii) inserting a ply separation tongue between an upper portion of the folded workpiece and a spaced lower portion thereof as the leading edge of the workpiece is clamped between the folding plate and the clamping plate;

iii) positioning a stop on said tongue, said stop being spaced from and movable into alignment with said guide;

iv) directing an alignment air flow against the upper portion of the workpiece after the leading edge thereof is released from between the folding plate and the clamping plate, and moving said upper portion of the workpiece against said stop in response thereto;

v) moving said stop into alignment with said guide; and vi) aligning the top portion of the hem with the bottom portion of the hem in response thereto.

22. The method of claim 14, wherein step h) further comprises the steps of moving a first transport clamp into engagement with the workpiece, accelerating the workpiece away from the folding plate at a first rate of speed with said first transport clamp along the first path of travel, and then decelerating said first transport clamp and the workpiece to a second rate of speed less than said first rate of speed for preventing the collapse of the workpiece and the formation of a curl in the leading edge of the workpiece.

23. The method of claim 22 and further comprising the steps of engaging the workpiece with a second transport clamp, releasing the workpiece from said first transport clamp, moving the workpiece across the surface of a transport table with said second transport clamp toward the seamer station, selectively rotating the workpiece with said second transport clamp as the workpiece is being moved across the surface of the transport table, and aligning said second side edge of the workpiece with the seamer station in response thereto.

24. A hemming and sewing machine for producing a finished hemmed, folded, and seamed workpiece, each workpiece having a leading edge, a spaced trailing edge, and a continuous hem sewn at the hemming station along a first side edge of the workpiece extending between the leading edge and the trailing edge thereof, the workpiece being conveyed leading edge first along a first path of travel on a first conveyor, said machine comprising:

a folding station positioned downstream of the hemming station adjacent the first path of travel;

a detector for detecting the leading and trailing edges, respectively, of the workpiece as it is moved along the conveyor toward said folding station;

a folding plate positioned at the folding station, said folding plate being supported above and generally parallel to the conveyor and having a first, upstream end and a spaced second, downstream end;

a clamping plate supported above said folding plate, said clamping plate being generally parallel to said folding plate and having a first upstream end and a spaced second downstream end; and means for creating a vacuum between said folding plate and said clamping plate to draw the leading edge of the workpiece between said folding plate and said clamping plate as the workpiece passes beneath the folding plate on the conveyor;

said clamping plate being constructed and arranged to be reciprocably moved into engagement with said folding plate for clamping the leading edge of the workpiece therebetween as the remainder of the workpiece continues to move beneath the folding plate and along the path of travel;

wherein the workpiece is at least partially folded over onto itself as it progresses along the first path of travel beyond said folding station.

25. The machine of claim 24, said means for creating a vacuum comprising a series of spaced first air jets positioned with respect to the second end of said clamping plate and being spaced from said folding plate, each said air jet being constructed and arranged to selectively direct an air flow between the folding plate and the spaced clamping plate from the second end toward the first end of each said plate, respectively.

26. The machine of claim 24, and further comprising;

a series of spaced second air jets positioned with respect to the first upstream end of said folding plate, each of said air jets being constructed and arranged to selectively direct an air flow beneath the folding plate in the direction of the first path of travel;

wherein said folding plate and said clamping plate are constructed and arranged to be reciprocably moved together and upwardly away from the first conveyor when the leading edge of the workpiece is clamped between said plates, said second series of air jets at least partially inflating at least a portion of the workpiece positioned between the folding plate and the conveyor for assisting in the folding of the workpiece as it moves along the first path of travel beneath the folding plate.

27. The machine of claim 24, and further comprising:

a stationary guide positioned with respect to the folding station adjacent the conveyor for engaging a bottom portion of the hem as the leading edge of the workpiece is held between the folding plate and the clamping plate; and an alignment device positioned with respect to said guide, said alignment device being constructed and arranged to align a top portion of the hem with the bottom portion of the hem as the workpiece is being folded over onto itself;

said alignment device including;

i) an elongate ply separator tongue constructed and arranged to be reciprocably and laterally inserted between an upper portion of the workpiece and a spaced lower portion of the workpiece with respect to the length of the workpiece as the leading edge of the workpiece is clamped between said folding plate and said clamping plate;

ii) a stop positioned on said tongue for engagement with the top portion of the hem; and iii) at least one air jet positioned with respect to said tongue and spaced above the upper portion of the workpiece when received on said tongue, said at least one air jet being constructed and arranged to guide the upper portion of the workpiece toward and into engagement with said stop; and iv) means for aligning said stop with said guides.

28. The machine of claim 24, further comprising;

a transport table positioned at the downstream end of the conveyor and said folding station; and a first transport clamp spaced above said transport table, said first transport clamp being movable along the first path of travel and adapted to engage the upper portion of the folded workpiece and the workpiece against the surface of the transport table;

wherein said first transport clamp is constructed and arranged to accelerate the workpiece away from the folding station at a first rate of speed, and to then decelerate the workpiece to a second rate of speed less than said first rate of speed for preventing the collapse of the workpiece and the formation of a curl in the leading edge of the folded workpiece.

29. The machine of claim 28, further comprising:

a second transport clamp spaced above said transport table;

said second transport clamp being supported for movement along a second path of travel extending away from the first path of travel;

said second transport clamp being constructed and arranged for reciprocable movement toward and away from the surface of the transport table to engage and hold the workpiece against the surface of the transport table, and to move the workpiece across the surface of the transport table into a downstream position along said second path of travel.

30. The machine of claim 28, further comprising a seamer station positioned downstream of said transport table and said first transport clamp, said seamer station being constructed and arranged to sew an elongate seam in a second side edge of the workpiece for joining the upper and lower portions thereof together.

31. The machine of claim 30, further comprising a workpiece stacking station positioned downstream of said seamer station, said seamer station being constructed and arranged to convey the workpiece toward said workpiece stacking station, said workpiece stacking station being constructed and arranged to transfer the workpiece onto a flip panel pivotally supported on the workpiece stacking station, and a bundle tray positioned with respect to the machine operator's station for permitting visual inspection of the completed workpieces by the machine operator, said flip panel being constructed and arranged to place hemmed, folded, and seamed workpieces within said bundle tray.

32. The machine of claim 24, and further comprising a computer control for the machine, wherein said detector is constructed and arranged to emit a leading edge detection signal to said computer in response to the detection of the leading edge of the workpiece, and to emit a trailing edge detection signal to said computer in response to the detection of the trailing edge of the workpiece.

33. The machine of claim 32, wherein said computer signals said clamping plate after a first predetermined period of time has elapsed to engage said folding plate in response to the receipt of said leading edge detection signal for clamping the leading edge of the workpiece therebetween, calculates a second period of time sufficient for the workpiece to be folded in half in response to the receipt of said trailing edge detection signal, and then signals said clamping plate to release the leading edge of the workpiece after said second period of time has elapsed.

34. The machine of claim 32, wherein said computer signals said clamping plate after a first predetermined period of time has elapsed to engage said folding plate in response to the receipt of said leading edge detection signal for clamping the leading edge of the workpiece therebetween, and then signals said clamping plate to release the leading edge of the workpiece after a second predetermined period of time has elapsed from the receipt of the leading edge detection signal, wherein the workpiece is folded over onto itself to form a workpiece of a pre-determined folded size in response thereto.

35. A hemming and sewing machine for producing a finished hemmed, folded, and seamed workpiece, the machine having an operator's station from which the machine is operated, each workpiece having a leading edge, a spaced trailing edge, the workpiece being conveyed leading edge first along a first path of travel on a first conveyor, said machine comprising:

a hemming station constructed and arranged to form a hem in a first side edge of the workpiece extending between the leading edge and the trailing edge thereof;

a folding station positioned downstream of the hemming station and along the path of travel, said folding station including:

i) a folding station detector constructed and arranged to detect the leading and trailing edges, respectively, of the workpiece as it is moves along the conveyor toward said folding station;

ii) a folding plate supported above and being generally parallel to the conveyor, said folding plate having a first upstream end and a spaced second downstream end;

iii) a clamping plate supported above said folding plate and being generally parallel thereto, said clamping plate having a first upstream end and a spaced second downstream end and being constructed and arranged to be reciprocably moved into engagement with said folding plate for clamping the leading edge of the workpiece therebetween; and iv) means for creating a vacuum between said clamping and folding plates for drawing the leading edge of the workpiece away from said conveyor and between said folding plate and said clamping plate as the remainder of the workpiece continues to move beneath the folding plate on the conveyor and along the path of travel;

wherein the workpiece is at least partially folded over onto itself at said folding station.

36. The machine of claim 35 and further including means for aligning a top portion of the hem with a bottom portion of the hem of the workpiece, said means being positioned with respect to said folding station.

37. The machine of claim 36, and further comprising:

a stationary guide positioned with respect to the folding station and adjacent the conveyor for engaging the bottom portion of the hem as the leading edge of the workpiece is held between the folding plate and the clamping plate;

said means for aligning the top portion of the hem with the bottom portion of the hem comprising an alignment device spaced above said guide with respect to said clamping plate, said alignment device being constructed and arranged to align the top portion of the hem over the bottom portion of the hem as the bottom portion of the hem it is engaged with said guide.

38. The machine of claim 37, wherein said alignment device further comprises:

an elongate ply separator tongue supported for reciprocal movement with respect to the workpiece being carried on the conveyor along the path of travel;

a two-way cylinder operably engaged with said ply separator tongue, said two-way cylinder being constructed and arranged to reciprocably and laterally insert said tongue between an upper portion of the workpiece and a spaced lower portion of the workpiece with respect to the length of the workpiece as the leading edge of the workpiece is clamped between said folding plate and said clamping plate;

a stop positioned on said tongue for engagement with the top portion of the hem; and at least one air jet positioned with respect to said tongue, said at least one air jet being spaced above the tongue and being constructed and arranged to guide the upper portion of the workpiece toward and into engagement with said stop.

39. The machine of claim 35 and further including a seamer station positioned downstream of said folding station, said seamer station being constructed and arranged to sew a continuous seam along a second side edge of the workpiece.

40. The machine of claim 39, said seamer station comprising:

a sewing head for sewing said seam in the second side edge of the workpiece a seamer detector positioned upstream of said sewing head, said seamer detector being constructed and arranged to emit a leading edge and a trailing edge detection signal to a computer in response to the detection of the leading and trailing edges of the workpiece, respectively.

41. The machine of claim 39 and further including a workpiece stacking station positioned downstream of said seamer station and with respect to the machine operator's station, said seamer station being constructed and arranged to move the workpiece toward said workpiece stacking station.

42. The machine of claim 41, said workpiece stacking station comprising:

a transfer plate positioned downstream of said sewing head for transferring the finished workpiece from the seamer station to a flip panel at said workpiece stacking station; and a transfer plate detector positioned upstream of said transfer plate, said transfer plate detector being constructed and arranged to emit a leading edge and a trailing edge detection signal to a computer in response to the detection of the leading and trailing edges of the workpiece, respectively;

said flip panel being pivotally supported on said machine and being constructed and arranged to place the workpiece into a into a bundle tray; and wherein said bundle tray is positioned with respect to the machine operator's station for permitting visual inspection of the completed workpieces by the machine operator.

43. The machine of claim 35, wherein said hemming station comprises:

a hemming folder for folding the first side edge of the workpiece to be hemmed;

a hemming folder detector positioned upstream of said hemming folder, said hemming folder detector being constructed and arranged to emit a detection signal to a computer in response to the detection of the leading and trailing edges of the workpiece, respectively;

a hemmer detector positioned downstream of said hemming folder, said hemmer detector being constructed and arranged to emit a detection signal to said computer in response to the detection of the leading and trailing edges of the workpiece, respectively; and a sewing head for sewing said hem in the workpiece.

44. The machine of claim 35, wherein said folding station detector is constructed and arranged to emit a detection signal to a computer control system for the machine in response to detecting the leading and trailing edges of the workpiece, respectively, said computer control system being constructed and arranged to signal said clamping plate to engage said folding plate after a first predetermined period of time has elapsed in response to the receipt of a leading edge detection signal from the folding station detector for clamping the leading edge of the workpiece therebetween, to then calculate a second period of time sufficient for the workpiece to be folded in half in response to the receipt of a trailing edge detection signal from said folding station detector, and to then signal the clamping plate to release the leading edge of the workpiece after said second period of time has elapsed, wherein the workpiece is folded over onto itself in half in response thereto.

45. The machine of claim 35, wherein said folding stationdetector is constructed and arranged to emit a detection signal to a computer control system for the machine in response to detecting the leading and trailing edges of the workpiece, respectively, said computer control system being constructed and arranged to signal said clamping plate to engage said folding plate after a first predetermined period of time has elapsed in response to the receipt of a leading edge detection signal from the folding station detector for clamping the leading edge of the workpiece therebetween, and to then signal the clamping plate to release the leading edge of the workpiece after a second predetermined period of time has elapsed from receipt of the leading edge detection signal, wherein the workpiece is folded over onto itself to form a workpiece of a pre-determined folded size in response thereto.

46. The machine of claim 35, said folding station further comprising:

a first two-way cylinder operably engaged with said clamping plate and being constructed and arranged to move said clamping plate toward and into engagement with, and away from said folding plate;

a second two-way cylinder operably engaged with both said folding plate and said clamping plate and being constructed and arranged to move both said folding plate and said clamping plate together toward and away from said conveyor.

47. The machine of claim 35, said folding station further comprising a spaced series of air jets positioned with respect to said folding plate at the first upstream end thereof, each of said air jets being constructed and arranged to selectively emit a jet of air in the direction of the path of travel beneath said folding plate as said folding plate and said clamping plate are holding the leading edge of the workpiece therebetween, said air jets at least partially inflating at least a portion of the workpiece held between said folding plate and said conveyor as the workpiece moves in the direction of the path of travel on said conveyor.

48. The machine of claim 35, said means for creating a vacuum comprising a spaced series of air jets positioned adjacent the second, downstream end of said clamping plate, each of said air jets constructed and arranged to selectively emit a jet of air between said folding and clamping plates in a direction opposite to the direction of the path of travel to create a venturi-effect air flow between said folding and clamping plates for creating said vacuum therein to draw the leading edge of the workpiece upwardly off of said conveyor and between said folding plate and said clamping plate.

49. The machine of claim 35, said machine further comprising a means for moving the workpiece from said folding station, said means for moving comprising:

i) a first transport clamp constructed and arranged to engage an upper portion of the folded workpiece and to hold a lower portion of the folded workpiece against the surface of said transport table;

ii) a first two-way cylinder operably engaged with said first transport clamp, said first two-way cylinder being constructed and arranged to move the first transport clamp and the folded workpiece across the surface of the transport table along the first path of travel; and iii) a second two-way cylinder operably engaged with said first transport clamp, said second two-way cylinder being constructed and arranged to move the first transport clamp toward and away from the surface of the transport table for clamping the workpiece thereagainst.

50. The machine of claim 49, wherein said first transport clamp, while engaged with the workpiece, is accelerated away from the folding station at a first rate of speed, and then decelerated to a second rate of speed less than said first rate of speed after a pre-determined period of time for preventing the formation of a curl in the leading edge of the workpiece.

51. The machine of claim 49, said means for moving the workpiece from said folding station further comprising:

a second transport clamp constructed and arranged to engage an upper portion of the folded workpiece and to hold a lower portion of the folded workpiece against the surface of said transport table;

a third two-way cylinder operably engaged with said second transport clamp, said third two-way cylinder being constructed and arranged to move the second transport clamp and the folded workpiece across the surface of the transport table along a second path of travel toward a seamer station; and a fourth two-way cylinder operably engaged with said second transport clamp, said fourth two-way cylinder being constructed and arranged to move the transport clamp toward and away from the surface of the transport table for clamping the workpiece thereagainst;

said second transport clamp being further constructed and arranged to selectively rotate the workpiece on the surface of the transport table as the workpiece is being moved across the surface thereof toward the seamer station for aligning said second side edge of the workpiece with the seamer station.

52. The machine of claim 35, wherein said machine has a substantially U-shaped configuration having a first leg along which said hemming station and said folding station lie, a downstream second leg of said machine, said second leg being generally perpendicular to said first leg, and a downstream third leg of said machine, said third leg being generally perpendicular to said first leg and extending toward a machine operator's station positioned with respect to the first leg of the machine.

* * * * *